US010349194B1

(12) United States Patent
Hoffman et al.

(10) Patent No.: US 10,349,194 B1
(45) Date of Patent: Jul. 9, 2019

(54) AUDITORY MASKING FOR A COHERENCE-CONTROLLED CALIBRATION SYSTEM

(71) Applicant: Facebook Technologies, LLC, Menlo Park, CA (US)

(72) Inventors: Pablo Francisco Faundez Hoffman, Redmond, WA (US); Scott Porter, Woodinville, WA (US); Philip Robinson, Seattle, WA (US); Antonio John Miller, Woodinville, WA (US); Ravish Mehra, Tacoma, WA (US)

(73) Assignee: FACEBOOK TECHNOLOGIES, LLC, Menlo Park, CA (US)

( * ) Notice: Subject to any disclaimer, the term of this patent is extended or adjusted under 35 U.S.C. 154(b) by 0 days.

(21) Appl. No.: 16/143,180

(22) Filed: Sep. 26, 2018

(51) Int. Cl.
*H04R 3/04* (2006.01)
*G10K 11/175* (2006.01)
*H04R 29/00* (2006.01)

(52) U.S. Cl.
CPC ..... *H04R 29/001* (2013.01); *G10K 11/175* (2013.01); *H04R 3/04* (2013.01); *H04R 2499/15* (2013.01)

(58) Field of Classification Search
CPC ... G10L 25/69; G10L 21/0232; G10L 19/005; G10L 25/21; G10L 19/028; G10L 19/03; G10L 19/24; G10L 21/02; G10L 21/0208; G10L 21/038; G10L 25/60; G10L 25/78; H04R 27/00; H04R 2227/005; H04R 25/356; H04R 3/002; H04R 2227/003; H04R 2420/07; H04B 1/16; H04H 20/26; H04H 2201/60; H04H 60/32; H04H 60/58; H04H 60/65; H04S 7/301
USPC ..... 381/56–58, 1, 28, 73.1; 704/500, 201; 700/94
See application file for complete search history.

(56) References Cited

U.S. PATENT DOCUMENTS

2003/0142833 A1* 7/2003 Roy ..... H04R 27/00 381/73.1
2003/0176934 A1* 9/2003 Gopalan ..... G11B 20/00891 700/94
2008/0243491 A1* 10/2008 Matsuoka ..... H04B 11/00 704/201
2013/0136282 A1* 5/2013 McClain ..... H03G 3/32 381/316
2015/0126144 A1* 5/2015 Jaisimha ..... H03G 3/3026 455/200.1
2015/0281829 A1* 10/2015 Gauger, Jr. ..... H04R 1/1083 381/71.6

* cited by examiner

*Primary Examiner* — Lun-See Lao
(74) *Attorney, Agent, or Firm* — Artegis Law Group, LLP

(57) ABSTRACT

A technique for auditory masking for a coherence-controlled calibration system includes generating a first auditory masking pattern based on a frequency spectrum of at least a first frame of a first audio signal. The technique continues by generating a first calibration signal based on the first auditory masking pattern. The technique then includes producing a combined input signal based on the first audio signal and the first calibration signal. The technique also includes performing one or more calibration operations based on the combined input signal.

21 Claims, 15 Drawing Sheets

AUDITORY MASKING FOR A COHERENCE-CONTROLLED CALIBRATION SYSTEM

BACKGROUND

Field of the Various Embodiments

The various embodiments relate generally to audio signal processing and, more specifically, to techniques for auditory masking for coherence-controlled calibration system.

DESCRIPTION OF THE RELATED ART

While listening to audio, the quality of sound of original audio playback material, such as for music or voice recordings, depends on the ability of an audio system to produce sound that accurately corresponds to the audio playback material. Dynamics of an audio playback device and the environment in which the device operates generally affect sound quality. For example, the environment and/or inherent frequency response of the audio system may introduce ambient noise.

Various audio playback devices require a calibration procedure to provide transparent audio reproduction of the audio playback material. Some calibration procedures are part of an initialization procedure for the audio system, while some calibration procedures are "always on" continually calibration the audio system during operation. When providing "always on" real-time transparent audio reproduction, the calibration system monitors the transfer function between the playback transducer and a reference point. In order to be effective, the always on calibration techniques implemented in an audio system need to operate consistently, independent of noise within the environment.

SUMMARY

A technique for auditory masking for a coherence-controlled calibration system includes generating a first auditory masking pattern based on a frequency spectrum of at least a first frame of a first audio signal. The technique continues by generating a first calibration signal based on the first auditory masking pattern. The technique then includes producing a combined input signal based on the first audio signal and the first calibration signal. The technique also includes performing one or more calibration operations based on the combined input signal.

Further embodiments provide, among other things, a system and a non-transitory computer-readable medium configured to implement the technique set forth above.

Advantageously, the disclosed techniques and system architectures allow for an audio system that can provide neutral audio reproduction based on a high coherence between the audio signal and the reference point.

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

Overview

Figure 1:
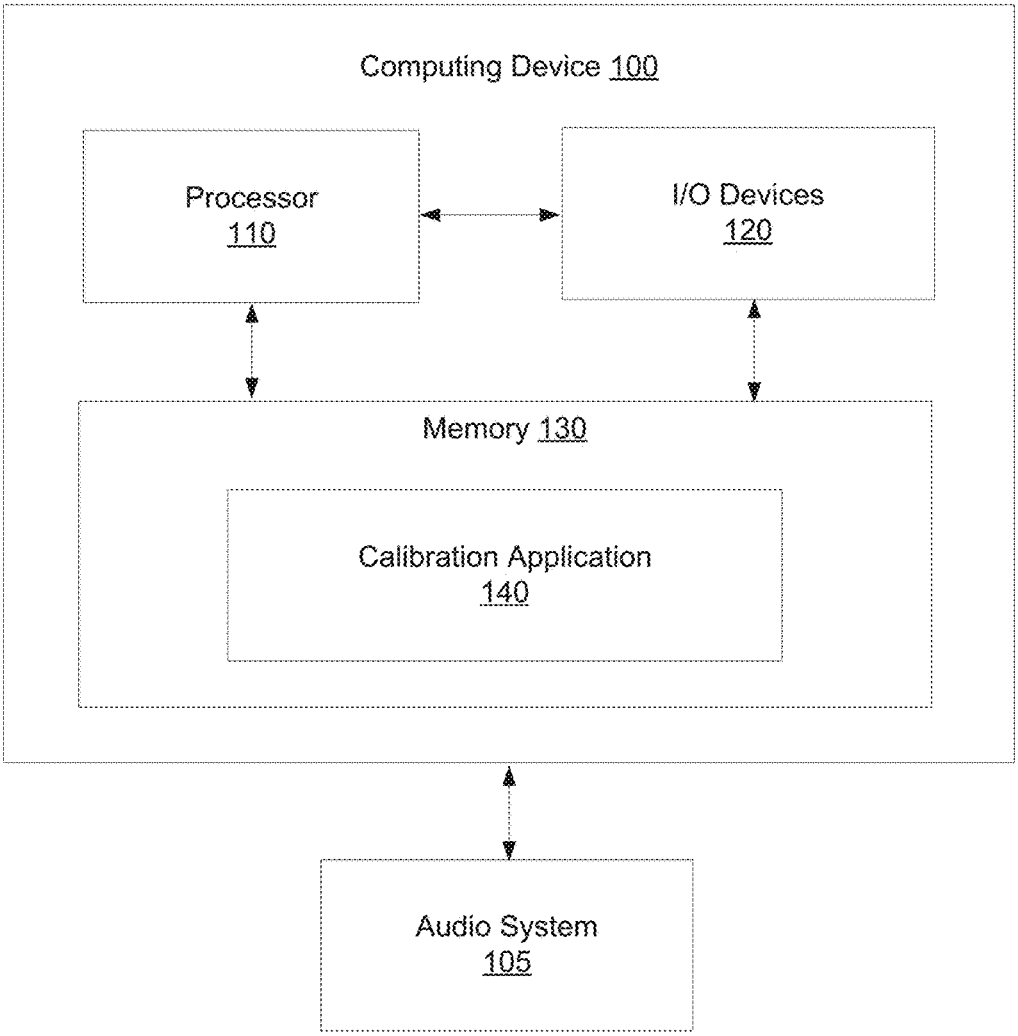
FIG. 1 illustrates a computing device configured to implement one or more aspects of an audio system, according to various embodiments.

In the following description, numerous specific details are set forth to provide a more thorough understanding of the various embodiments. However, it will be apparent to one of skilled in the art that the inventive concepts may be practiced without one or more of these specific details.

In various embodiments, an audio system, such as an audio playback device, may utilize a calibration procedure so that the audio system may provide transparent audio reproduction having a frequency response that does not affect the spectrum of the original audio playback material. Such a calibration procedure may be involved in the reproduction of binaural audio over headphones, room correction for speaker-based stereo and surround setups, and multi-speaker setups for ambisonic reproduction or wavefield synthesis, just to name a few examples. In various embodiments, to provide a substantially neutral reproduction in the case of binaural reproduction over headphones, for instance, a microphone may be placed at the entrance to an ear canal of a person to estimate a headphone-to-microphone transfer function. A portion of an inaudible signal may be added to an input audio signal before estimating the transfer function. The transfer function may be estimated continuously or on a periodic basis. An equalization filter may be derived from the inverse of the estimated transfer function. During operation, such an audio system may operate independently of the audio source material.

Embodiments herein present techniques for calibrating an audio system to account for various audio source material and noise. In various embodiments, an initial comparison of an input audio signal to the captured audio signal does not have a high coherence, due to additional audio signal in the captured audio signal (e.g., the intrusion of environmental noise). Various embodiments include a calibration technique that maintains a high coherence between the input audio signal and the captured audio signal without altering the audio signal heard by a user.

In various embodiments, the calibration technique may involve decomposing time-domain representations of various audio signals to frequency-domain representations of the various audio signals. The calibration technique also involves injecting an inaudible calibration signal to the input audio signal to generate a combined signal. The combined signal enables the calibration system to maintain a high coherence between the combined signal and a captured audio signal that is based on the combined signal. A high coherence between the combined signal and the captured audio signal enables the calibration system to provide a filter that effectively adjusts the combined signal before the audio system reproduces the combined signal. In various embodiments, the calibration technique may also involve calculating an estimated transfer function associated with a speaker and a microphone of the audio system, as described below.

Coherence-Based Transfer Function Computation

FIG. 1 illustrates a computing device 100 configured to implement one or more aspects of an audio system 105, according to various embodiments described below, for example. As illustrated, computing device 100 includes a processor 110, input/output (I/O) devices 120, and a memory 130. Memory 130 includes a calibration application 140 configured to calibrate audio system 105 using a continual calibration technique, for example. In some embodiments, computing device 100 may be electrically connected (e.g., wirelessly or wired) to audio system 105.

Processor 110 may be any technically-feasible form of processing device configured to process data to generate output, such as by executing program code. For example, processor 110 can be, without limitation, a central processing unit (CPU), a graphics processing unit (GPU), an application-specific integrated circuit (ASIC), a field-programmable gate array (FPGA), an analog signal processor (ASP) (e.g., an analog noise cancellation circuit), and so forth.

In various embodiments, memory 130 may include a memory module, or a collection of memory modules. Processor 110 may execute calibration application 140, stored within memory 130, to implement the overall functionality of computing device 100. For example, and without limitation, processor 110 may receive an audio signal captured at a microphone of audio system 105 ("captured audio signal") and a playback audio signal provided to a speaker of audio system 105 ("input audio signal"). Processor 110 may synchronize the input audio signal with the captured audio signal to generate a synchronized audio signal. In various embodiments, processor 110 may decompose the input audio signal and captured audio signal into frequency representations of the respective signals. In some embodiments, processor 110 decomposes the synchronized audio signal into a frequency representation of the synchronized audio signal. Processor 110 may then calculate an estimated transfer function associated with the speaker and the microphone based at least on the frequency representations of the respective audio signal. Details regarding these operations are provided below in conjunction with FIGS. 2-8.

I/O devices 120 may include input devices, output devices, and devices capable of both receiving input and providing output. For example, and without limitation, I/O devices 120 can include wired and/or wireless communication devices that send information between processor 110 and audio system 105, and/or multiple speakers of I/O devices 120.

Audio system 105 may include any of a number of types of audio playback devices involved in any of a number of types and/or situations, such as the reproduction of binaural audio over headphones, room correction for speaker-based stereo and surround setups, multi-speaker setups for ambisonic reproduction or wavefield synthesis, and so on. In various embodiments, audio system 105 may provide original playback material and captured audio to computing device 100 via I/O devices 120. The captured audio may be captured by a microphone included in audio system 105, as described below. In addition, computing device 100 may provide modified playback material to audio system 105. Such modification may involve audio equalization (EQ) applied to the original playback material and based, at least in part, on the captured audio. For example, the audio equalization may adjust balances between different frequency ranges of the input audio signal during playback.

Figure 2:
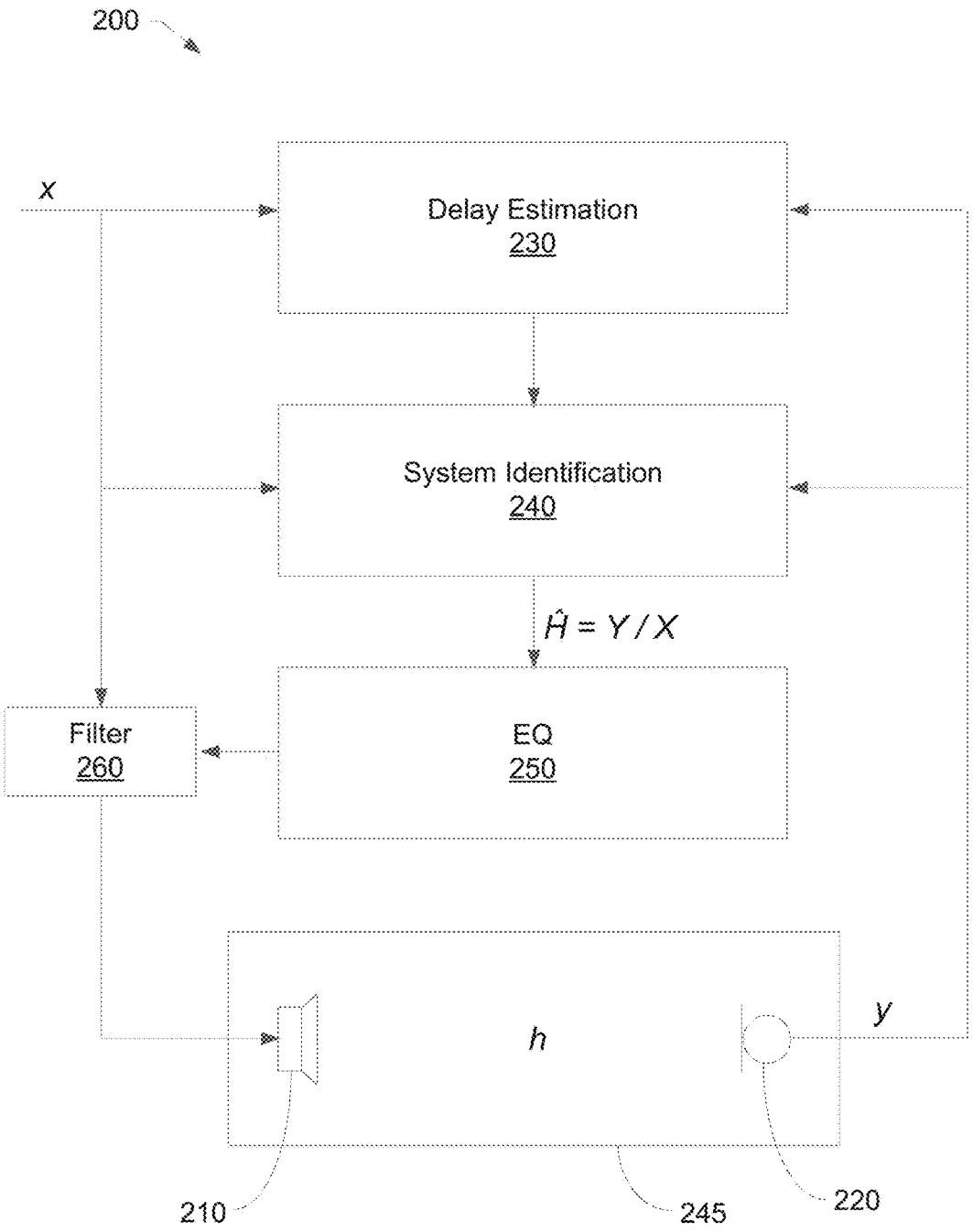
FIG. 2 is a block diagram of an audio calibration system implemented by the computing device of FIG. 1, according to various embodiments.

FIG. 2 is a block diagram of an audio calibration system 200 implemented by the computing device 100 of FIG. 1, according to various embodiments. As illustrated, audio calibration system 200 includes a speaker 210, a microphone 220, a delay estimation module 230, a system identification module 240 and an EQ module 250, and a filter 260. Delay estimation module 230, system identification module 240, EQ module 250, and filter 260 may be included in computing device 100 of FIG. 1. In various embodiments, audio calibration system 200 may be used for audio system 105, which may include one or more speakers 210 and one or more microphones 220. Hereinafter, embodiments are described as involving a single speaker 210 and a single microphone 220, though claimed subject matter is not limited in this respect.

Delay estimation module 230 may receive and synchronize an input audio signal x with a captured audio signal y, where the captured audio signal is captured by microphone 220. Input audio signal x is an electronic or digital signal provided by audio system 105 for audio rendering by speaker 210, for example. Captured audio signal y is an electronic or digital signal generated by microphone 220 in response to microphone 220 receiving a physical audio signal from speaker 210, via an air path, for example. In various embodiments, microphone 220 generates the captured audio signal from the received input audio signal. Delay estimation module 230 may synchronize the input audio signal and captured audio signal so that the two signals x and y substantially overlap with one another. For example, delay estimation module 230 may delay the input audio signal x, causing the input audio signal to be substantially in phase with the captured audio signal y.

System identification module 240 processes both the input audio signal x and the captured audio signal y to analyze both signals. In various embodiments, system identification module 240 may decompose the audio signals into frequency representations of the respective audio signals. In some embodiments, one or more of the frequency representations may be modified after decomposition. For example, various embodiments of system identification module 240 inject inaudible signals into the frequency representation of the input audio signal in order to generate a combined audio signal. In such instances, system identification module 240 may generate an estimated transfer function between the combined audio signal and the captured audio signal.

In some embodiments, system identification module 240 may generate sub-band representations of the input audio signal x and the captured audio signal y. Such representations are generated via sub-band coding (SBC), which is a form of transform coding that uses a transform, such as a fast Fourier transform (FFT), to decompose and separate an a time-domain representation of a signal into a number of different frequency bands. Upon generating multiple bands of a signal, system identification module 240 may subsequently process and/or analyze each band independently of the other bands.

Transfer function 245 for an environment, represented as h in FIG. 2 between speaker 210 and microphone 220, represents the output of audio system 105 for each input. As shown, transfer function 245 represents the relationship between captured audio signal y and a playback audio signal provided by speaker 210. In various embodiments, speaker 210 may playback the input audio signal x. In other embodiments, speaker 210 may playback a combined audio signal provided by system identification module 240. In various embodiments, transfer function 245 may be estimated by system identification module 240. In such instances, system identification module 240 generates an estimated transfer function $\hat{H}$ based on the frequency representation of the captured audio signal y and the frequency representation of the audio signal to be produced by speaker 210. For example, system identification module can generate the estimated transfer function between the captured audio signal and one of the input audio signal, the synchronized audio signal, or a combined audio signal.

Audio equalization (EQ) module 250 may receive the estimated transfer function from system identification module 240 and may derive an equalization filter 260 based on the estimated transfer function. In various embodiments, EQ module 250 may generate an equalization filter 260 that adjust balances between different frequency ranges of a received audio signal.

Filter 260 filters the input audio signal x before playback by speaker 210. In various embodiments, equalization filter 260 may individually adjust each of a number of frequency components (or frequency ranges) of a received audio signal. Such filtering allows for calibrating an audio signal to account for noise and various aspects of sound reproduction by audio system 105. For example, filter 260 can receive the input audio signal x and can balance different frequency ranges of the input audio signal before speaker 210 reproduces the filtered version of the input audio signal. In various embodiments, filter 260 may adjust a received combined audio signal before speaker 210 reproduces the filtered version of the combined audio signal.

Figure 3A:
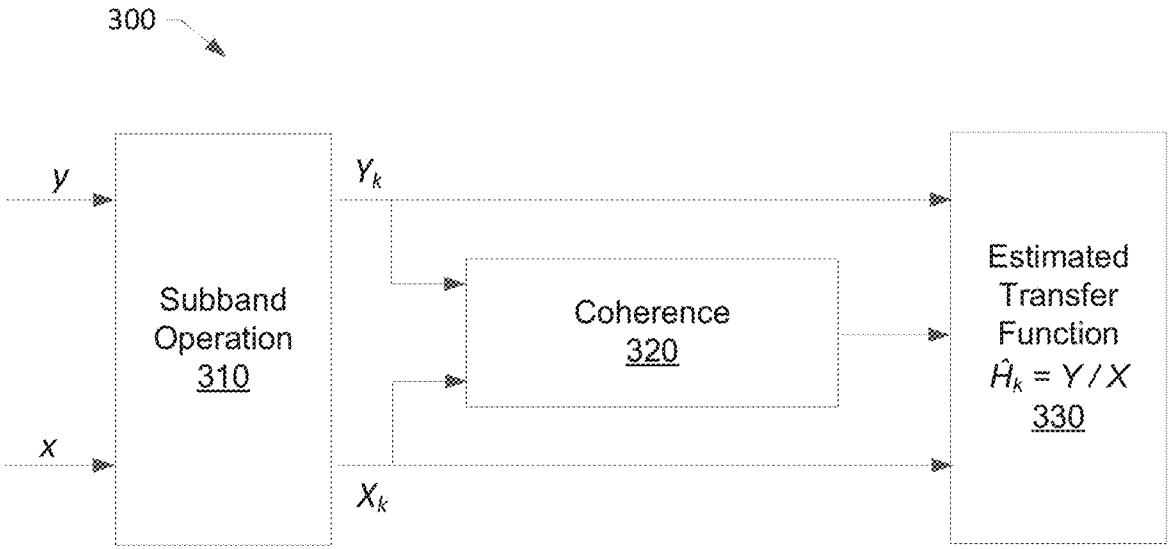
FIG. 3A is a block diagram of the system identification module included in the audio calibration system of FIG. 2, according to various embodiments.

FIG. 3A is a block diagram of system identification module 240 included in audio calibration system 200 of FIG. 2, according to various embodiments. As shown, system identification block 300 includes a sub-band operation module 310, a coherence computation module 320, and am estimated transfer function computation module 330. In various embodiments, system identification module 300 generates an estimated transfer function $\hat{H}$ between the captured audio signal Y and the input audio signal X and may update the estimated transfer function based on a coherence value generated by coherence computation module 320.

Sub-band operation module 310 receives both input audio signal x and captured audio signal y. Sub-band operation module 310 transforms each of the received signals into respective sub-band representations, expressed as k-band values for the input audio signal $X_k$ and the captured audio signal $Y_k$. In various embodiments, $X_k$ represents the synchronized audio signal. The sub-band representation of a given audio signal enables system identification module 300 to perform calibration operations in the frequency domain. Separating the frequency representation of a given audio signal into separate sub-bands enables sub-band operation module 310 to treat different frequency bands of the playback signal differently from one another. For example, depending on the type of audio source material, equalization filtering may be applied differently to different frequency bands of the input audio signal.

Coherence computation module 320 may estimate the coherence between two signals. As shown, coherence computation module 320 computes a coherence value between the captured audio signal $Y_k$ and the input audio signal $X_k$. Coherence is a measure of similarity between two input signals. The coherence value is computed as a measured scaled between 0 and 1, where a higher value indicates a greater similarity between the respective signals. For example, a coherence value of 1 indicates that the two input signals are perfectly related through a linear time invariant (LTI) system. Conversely, a coherence value of 0 indicates that the input signals are uncorrelated and independent of one another. The coherence value, which may be computed as a magnitude-squared (MS) coherence, may be used by system identification module 300 to control estimated transfer function computation module 330. For example, system identification may use the coherence value to determine whether to update the estimated transfer function. In various embodiments, system identification module 240 may generate an estimated transfer function for each of k sub-bands.

In various embodiments, EQ module 250 uses the estimated transfer function $\hat{H}$ to derive an equalization filter. For example, EQ module 250 can derive an equalization filter 260 that is the reciprocal of $\hat{H}$. When generating equalization filter 260 as a function of the estimated transfer function, EQ module 250 generally relies on the captured audio signal y having a substantially linear relation to the input audio signal x, or to the synchronized audio signal. For example, a high coherence value (e.g., a coherence value above 0.8) indicates an approximately linear relationship between the two input signals. When coherence computation module 320 computes a high coherence value, equalization filter 260 may effectively adjust the input audio signal x before speaker 210 performs playback of the input audio signal.

Estimated transfer function computation module 330 generates an estimated transfer function for a given frequency range. In various embodiments, estimated transfer function computation module may generate a broadband estimated transfer function $\hat{H}$. In some embodiments, when sub-band operation module 310 generates multiple bands for the respective audio signals, estimated transfer function computation module 330 generates an estimated transfer function $\hat{H}_k$ for each individual spectral band of a total of k spectral bands. Estimated transfer function computation module 330 may generate an estimated transfer function $\hat{H}$ corresponding to the transfer function h 245 between speaker 210 and microphone 220. The estimated transfer function may be a complex ratio or magnitude frequency ratio $\hat{H}=Y_k/X_k$ between the captured audio signal $Y_k$ and the input audio signal $X_k$. In various embodiments, estimated transfer function computation module 330 may compute the estimated transfer function between the captured audio signal and the synchronized audio signal.

In various embodiments, system identification module 300 may control when the estimated transfer function is updated based on the computed coherence value. For example, the computed coherence value may determine the speed and/or the smoothness of the update to the estimated transfer function performed by system identification module 300. When estimating a transfer function for a particular frequency range or sub-band k, the following exponential averaging relation may be used:

$$\hat{H}^t_k=\alpha k\hat{H}^{t-1}_k+(1-\alpha_k)H'k, \quad \text{Equation 1}$$

where $\hat{H}^t_k$ is the current estimated transfer function for the kth-band and $\hat{H}^{t-1}_k$ is the previous estimate for the kth-band. $H'_k$ is the instantaneous estimate and $\alpha_k$ is a smoothing factor for spectral band k, which is in a range from 0 to 1 for the kth-band.

Figure 3B:
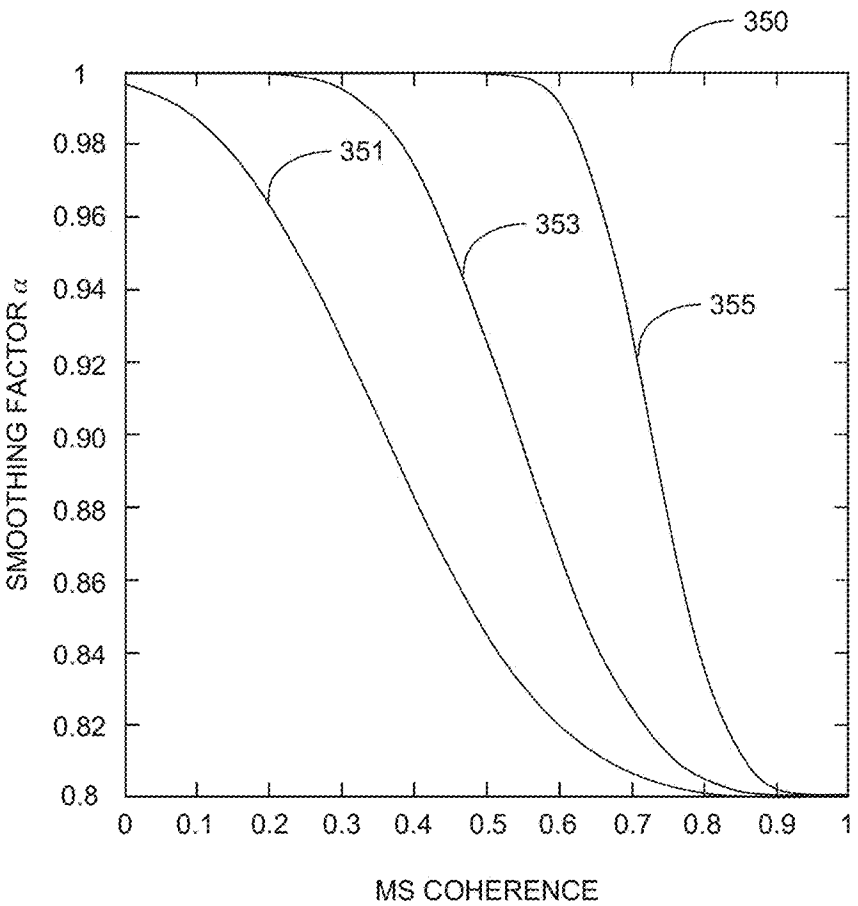
FIG. 3B is a graph of smoothing factor $\alpha$ versus coherence values for several different values of a signal-to-noise ratio (SNR), according to various embodiments.

FIG. 3B is a graph 350 of smoothing factor $\alpha$ versus coherence values for several different values of a signal-to-noise ratio (SNR), according to various embodiments. For example, curve 355 is more sensitive to a reduction in the coherence value than either of curves 351 and 353. In particular, curve 355 will slow down the update rate quicker than curves 351 and 353. In various embodiments, a functional relationship between the smoothing factor $\alpha$ and the coherence value is based, at least in part, on psycho-acoustic parameters. One or more of the psycho-acoustic parameters consider, for example, human (or animal) sound perception and audiology, as well as the psychological and physiological responses associated with sound.

In various embodiments, to control the effect of the bandwidth of x and the acoustic background noise, a depends, at least in part, on the sub-band coherence. In some embodiments, if the SNR is relatively low, then the speed of updates to the estimated transfer function is decelerated, or in some instances, stopped. A relatively low SNR may occur, for example, for either low energy in x, or relatively-high noise energy. In some embodiments, if the SNR is relatively high, then the speed of updates to the estimated transfer is accelerated. Thus, the rate in which estimated transfer function computation module 330 updates the estimated transfer function is based, at least in part, on the smoothing factor $\alpha$ that depends. The smoothing factor, in turn, depends on the coherence value.

If the coherence value is relatively large, then there is a strong relationship between y and x, and a has a value leading to relatively fast (e.g., frequent) updates. Conversely, if the coherence value is relatively small, then there is a weak relation between y and x, and a has a value leading to relatively slow (e.g., infrequent) updates. Moreover, if the coherence value is particularly small, then the frequency of the updates approaches zero. In such instances, updates to the estimated transfer function may not occur. The relationship between the coherence value and the frequency of updates to the estimated transfer function allows for audio system 105 to update the estimated transfer function of varying k at a rate that is high enough so that audio system 105 is well-calibrated, but low enough to avoid audio artifacts resulting from large jumps between consecutive estimated transfer functions.

Injecting Signals to Improve Coherence

Figure 4:
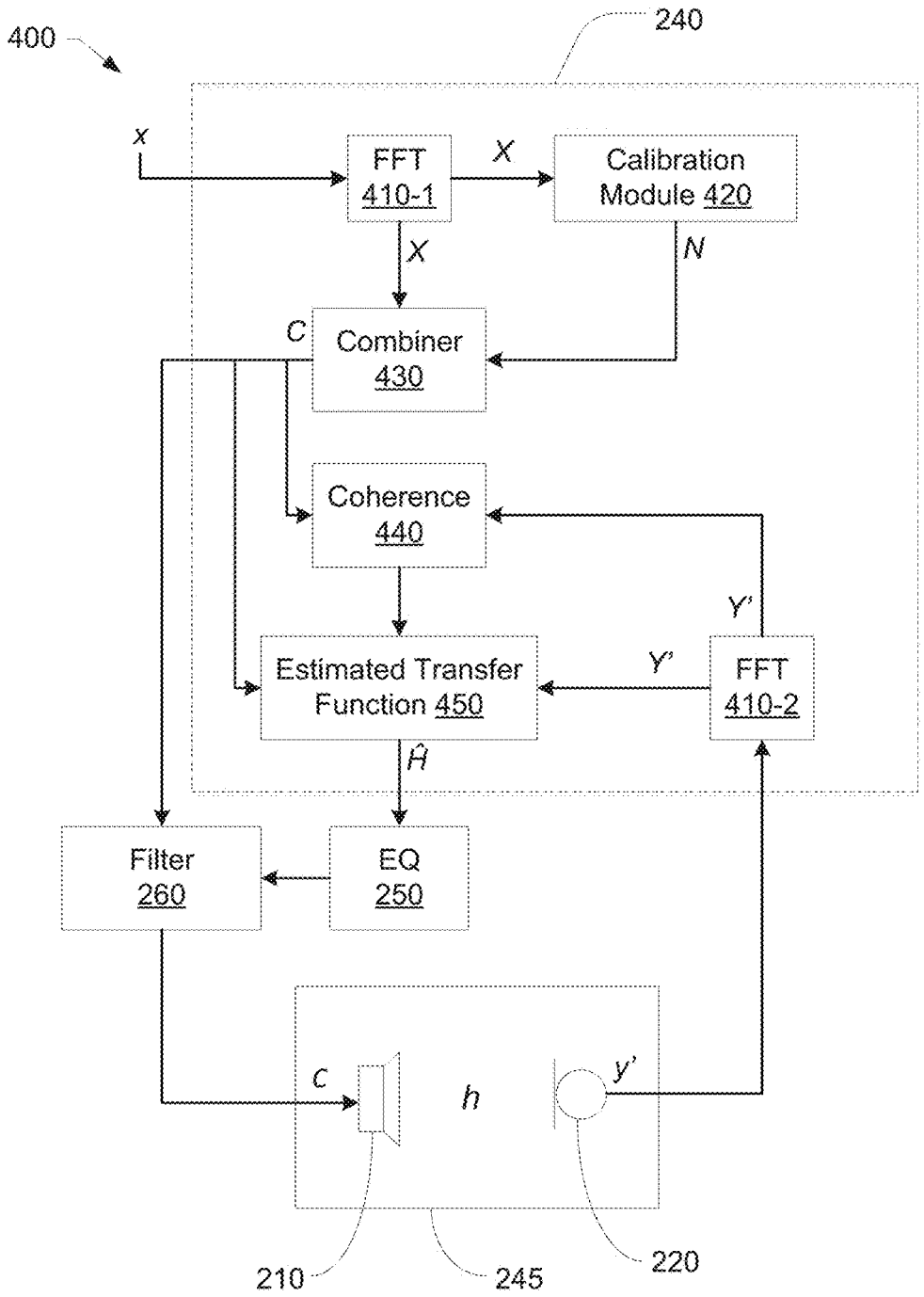
FIG. 4 is a detailed block diagram of a portion of the audio calibration system of FIG. 2, according to various embodiments.

FIG. 4 is a detailed block diagram of a portion of the audio calibration system 200 of FIG. 2, according to various embodiments. As shown, audio calibration system 400 includes system identification module 240, EQ 250, filter 260 and transfer function 245 between a combined audio signal produced by speaker 210 and a captured audio signal recorded by microphone 220. System identification module 240 includes fast Fourier transforms (FFT) 410-1 and 410-2, a calibration module 420, a combiner 430, a coherence computation module 440, and an estimated transfer function computation module 450. During operation, system identification module 240 may generate a combined audio signal c by injecting one or more inaudible signals, such as a calibration signal, into the input audio signal x. Speaker 210 reproduces the combined audio signal, while microphone 220 records the captured audio signal y.

Fast Fourier transforms (FFT) 410-1, 410-2 are modules, where each module decomposes a time-domain representation of a given signal to generate a frequency-domain representation of the given signal. As shown, FFT 410-1 decomposes the input audio signal x to its frequency-domain representation, i.e., input audio signal X. FFT 410-2 decomposes the captured audio signal y to its frequency-domain representation, i.e., the captured audio signal Y. In various embodiments, FFT 410-1 decomposes the synchronized audio signal generated by delay estimation module 230. In various embodiments, system identification module 240 receives one or more audio signals as frequency-domain representations of the audio signals. In such instances, one or more of FFT 410-1 and/or 410-2 can be excluded from system identification module 240.

Calibration module 420 receives the input audio signal X and generates a calibration signal N that is based on the input audio signal X. In various embodiments, calibration module 420 may initially generate an auditory masking pattern from the input audio signal X. In some embodiments, calibration module 420 receives the synchronized audio signal (as discussed above). In such instances, calibration module 420 generates the auditory masking pattern from the synchronized audio signal.

The auditory masking pattern is a broadband auditory mask that represents a threshold of audibility. Audio signals that haver energies below that of the auditory masking pattern are inaudible. In various embodiments, calibration module 420 may generate an auditory masking pattern in order to generate a one or more signals, e.g., calibration signal N, that is inaudible to a listener during playback. For example, calibration module 420 can receive an input audio signal x that has a constant energy, specified as a sound pressure of J dB SPL, throughout its frequency range. Calibration module 420 can measure the input audio signal and generate an auditory masking pattern of M dB SPL based on measuring the input audio signal. In such instances, the input audio signal x will mask other audio signals that have energies below M dB SPL.

In various embodiments, upon generating the auditory masking pattern, calibration module 420 may generate an inaudible signal corresponding to the auditory masking pattern. In various embodiments, calibration module 420 may generate a broadband calibration signal N for the same frequency range as the input audio signal x, where the calibration signal N has a maximum energy below the energy specified by the auditory masking pattern. In some embodiments, the maximum energy of the calibration signal N remains at a threshold level below the energy level specified by the auditory masking pattern. For example, calibration module 420 may generate a calibration signal N that has a maximum energy level that is f dB SPL below the energy level of the auditory masking pattern.

In various embodiments, calibration module 420 may generate one or more other inaudible signals. For example, in some embodiments, calibration module 420 may generate one or more inaudible control signals (not shown) that have energies below the energy of the auditory masking pattern. When such inaudible signals are injected into the input audio signal, the combined signal includes the additional signal, where the additional signal is inaudible to the user. In such instances, the captured audio signal may also capture the inaudible signal.

In various embodiments, calibration module 420 may generate a calibration signal for a specific frequency range. For example, calibration module 420 may determine a frequency range in which an additional signal is to be injected into the input audio signal X. In such instances, calibration module 420 may generate a narrowband calibration signal N for the specific frequency range. Similarly, when system identification module 240 uses sub-band operation module 310 to generate multiple bands of the input audio signal $X_k$, for each of k bands, calibration module 420 may generate an independent calibration signal $N_k$.

Combiner 430 combines the input audio signal X and the calibration signal N in order to produce a combined audio signal C. In some embodiments, combiner 430 combines the synchronized audio signal with the captured audio signal in order to produce the combined audio signal. In various embodiments, combiner 430 injects the calibration signal N for specific frequency ranges into the input audio signal. In such instances, the combined audio signal C includes one or more narrowband calibration signals $N_k$ extracted from the calibration signal N. The calibration signal N has a maximum energy below the energy of the input audio signal X; the calibration signal included in the combined audio signal C is inaudible to a listener when reproduced by speaker 210. Microphone 220, however, records the calibration signal c as part of the captured audio signal y. In various embodiments, the input audio signal X acts as an auditory mask that renders the calibration signal N and/or noise (e.g., environmental noise) included in the combined audio signal C inaudible.

In various embodiments, calibration module 420 may use the auditory masking pattern to generate the calibration signal N for one or more frames of the input audio signal X. In such instances, combiner 430 may combine the generated calibration signal N with multiple frames of the input audio signal. For example, combiner 430 can combine the generated calibration signal with a first frame of the input audio signal. Combiner 430 can also combine the generated calibration signal with a second frame of the input audio signal. The second frame may be a frame of audio subsequent to the first frame within the same audio input.

In various embodiments, system identification module 240 may determine whether to generate an updated auditory masking pattern and/or an updated calibration signal before combiner 430 combines one of the generated calibration signal or the updated calibration signal with the second frame of the input audio signal. For example, system identification module 240 may store one or more frame of the input audio signal and may compare the difference between the stored frames. When the difference between frames is above a threshold, system identification module 240 may cause calibration module 420 to update the auditory masking pattern and/or the calibration signal.

In various embodiments, estimated transfer function computation module 450 may compute an estimated transfer function $\hat{H}$ based on the relationship between the combined audio signal C and the captured audio signal Y'. In various embodiments, estimated transfer function 450 computes an estimated transfer function between a current frame of the combined audio signal C and a previous frame of the captured audio signal Y'. System identification module 240 may then transmit the estimated transfer function to EQ module 250 in order for EQ module 250 to generate an applicable equalization filter 260 for the combined audio signal.

Coherence computation module 440 computes a coherence value between the combined audio signal C and the captured audio signal Y'. In various embodiments, coherence computation module 440 computes a coherence value between a current frame of the combined audio signal C and a previous frame of the captured audio signal Y'. As discussed above in relation to FIG. 3A, estimated transfer function module 450 may change the rate that the estimated transfer function is updated based on the coherence value computed by coherence computation module 440.

Figure 5A:
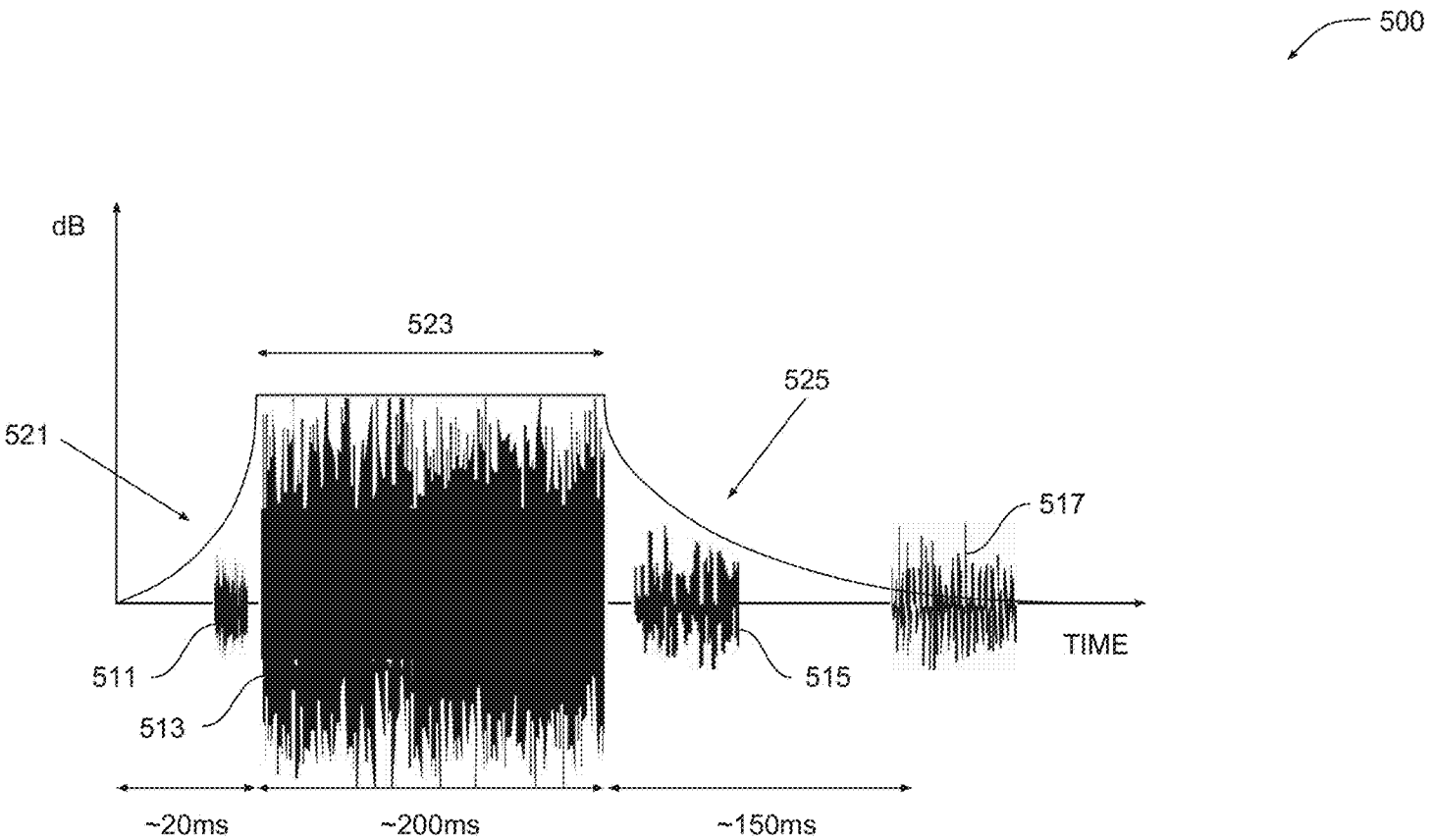
FIG. 5A is a graph of masking curves for portions of an audio input signal, according to various embodiments.

FIG. 5A is a graph of masking curves for portions of an audio input signal, according to various embodiments. As shown, graph 500 shows a masking pattern that includes a pre-mask 521, a concurrent mask 523, and a post-mask 525. The audio signal includes masked sounds 511, 515, masker 513, and unmasked sound 517.

Masker 513 is a portion of the audio signal that generates the auditory mask, including pre-mask 521, concurrent mask 523, and post-mask 525. In various embodiments, masker 513 may be a component of time-domain representation of the input audio signal x. Other sounds, such as masked sounds 511 and 515, have energies below auditory mask 521-525 and are inaudible to a listener. In various embodiments, one or more microphones may record masked sounds 511 and 515 while masked sounds 511, 515 remain inaudible to a listener. For example, when speaker produces a combined audio signal c that includes masker 513, masked sounds 511, 515, and unmasked sound 517, microphone 220 may record each of audio signals 511-517. In such instances, masked sounds 511, 515 are inaudible to a listener. Conversely, masker 513 and unmasked sound 517, which has energy that exceeds post-mask 525, are audible to the listener.

Figure 5B:
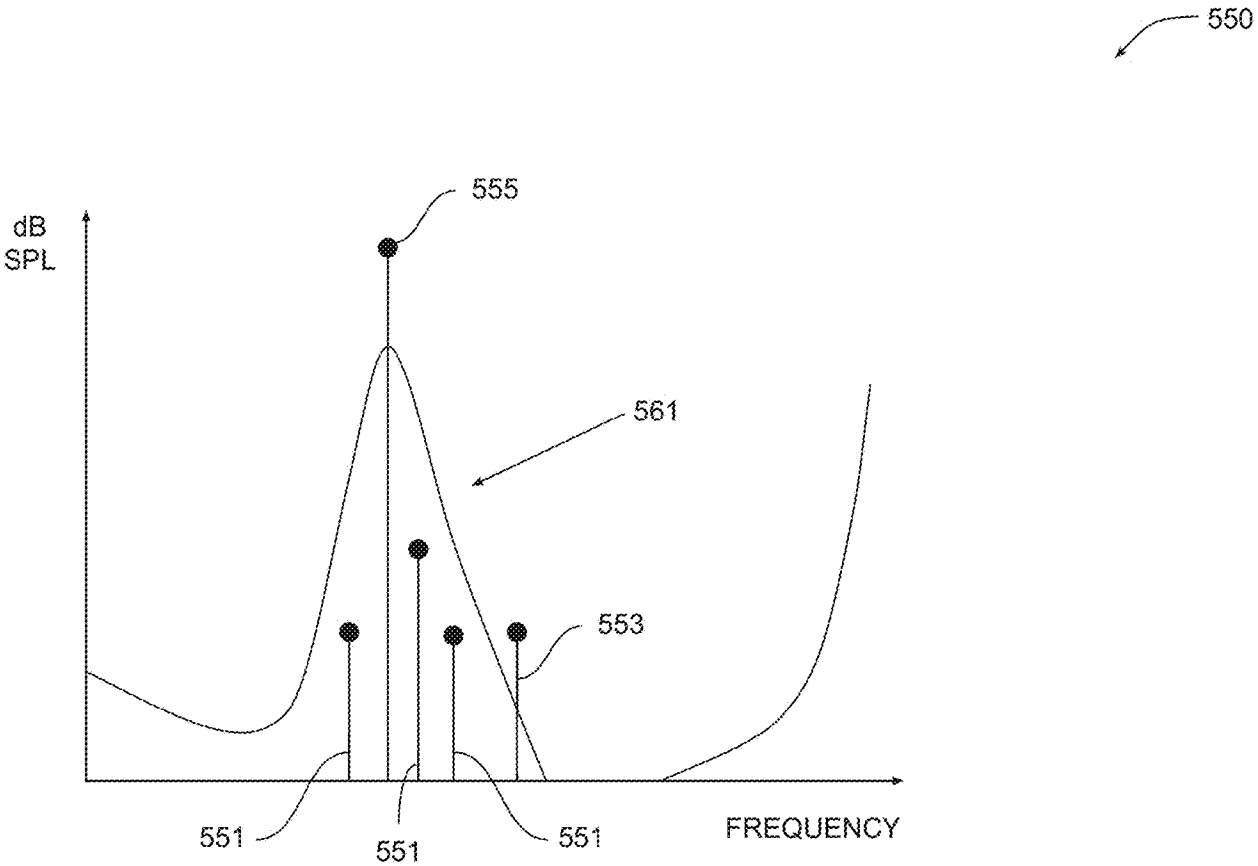
FIG. 5B is a graph of a masking curve derived from the spectrum of an audio input signal, according to various embodiments.

FIG. 5B is a graph of a masking curve derived from the spectrum of an audio input signal, according to various embodiments. As shown, graph 550 shows an auditory mask 561. The audio signal includes masked tones 551, masker tone 555, and unmasked tone 553. Masker tone 555 generates auditory mask 561 for the given frequency range. As shown, masker tone 555 is a frequency-domain representation of masker 513; masking pattern 561 is a frequency-domain representation of auditory mask 521-525. Similarly, tones 551-555 are frequency domain representations of corresponding audio signals 511-517.

As shown, masker tone 555 generates auditory mask 561 that causes masked tones 551 to be inaudible to a listener during playback of the audio signal, while unmasked tone 553 remains audible to the listener. During operation, system identification module 240 may implement calibration module 420 to produce a calibration signal including one or more tones that have energies below the energy of auditory mask 561. In such instances, masked tones 551 are inaudible to the listener during playback.

Figure 6A:
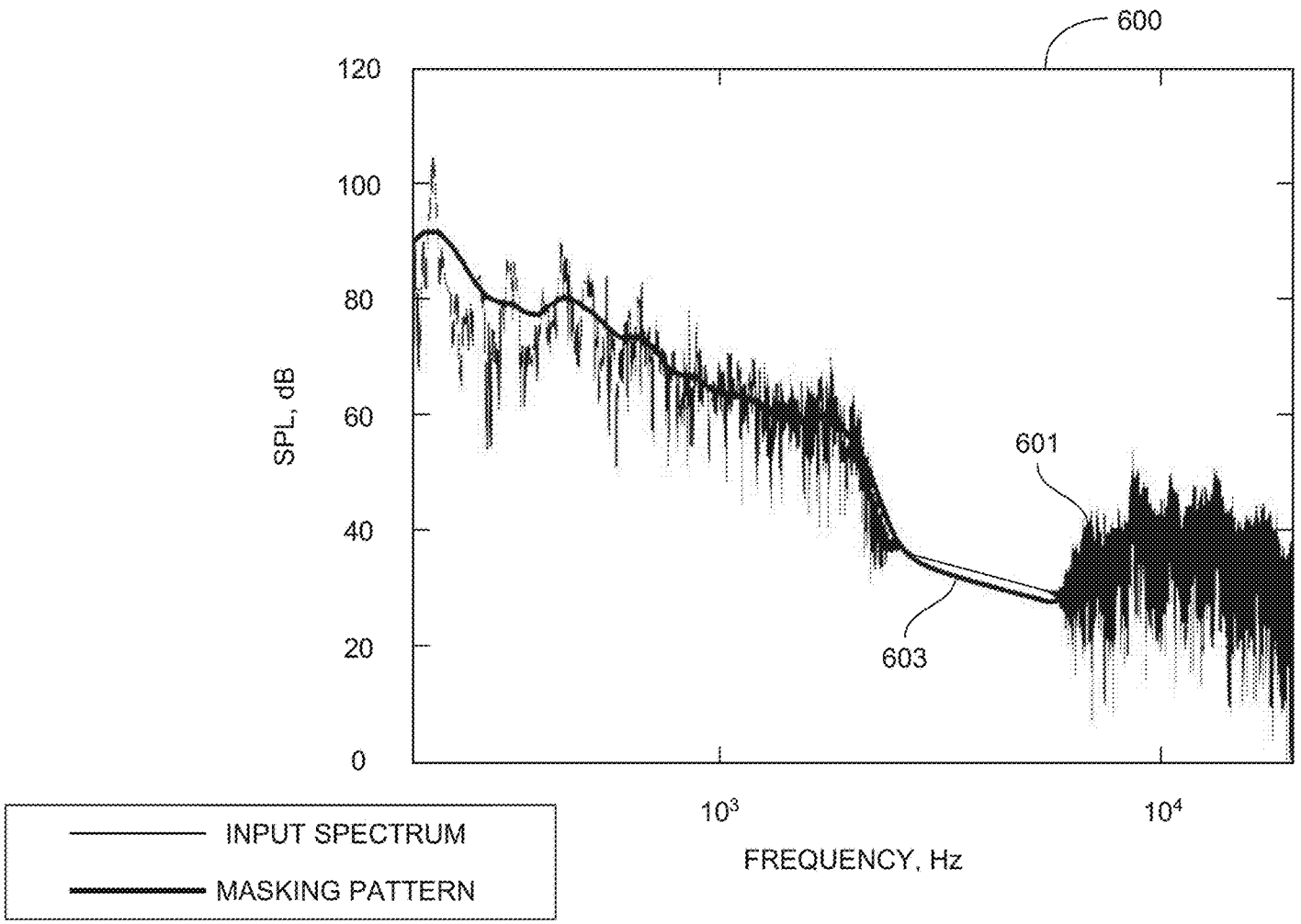
FIG. 6A is a graph of a masking pattern associated with a spectrum of an audio input signal, according to various embodiments.

FIG. 6A is a graph of a masking pattern associated with a spectrum of an audio input signal, according to various embodiments. Graph 600 shows an input spectrum 601 corresponding to a frequency representation of input audio signal x, and an auditory masking pattern 603 generated from input spectrum 601. During operation, calibration module 420 may measure input spectrum 601 and may generate auditory masking pattern 603 based on the measured input spectrum.

As shown, calibration module 420 may measure an input audio signal x as input spectrum 601. When input spectrum is used as a masking signal, input spectrum 601 provides an auditory mask. In various embodiments, calibration module 420 may generate auditory masking pattern 603 corresponding to the auditory mask provided by input spectrum 601. In such instances, calibration module 420 can produce a calibration signal with an energy below auditory masking pattern 603 such that the calibration signal is inaudible to a listener during playback, but is recorded by microphone 220 and included in the captured audio signal y.

Figure 6B:
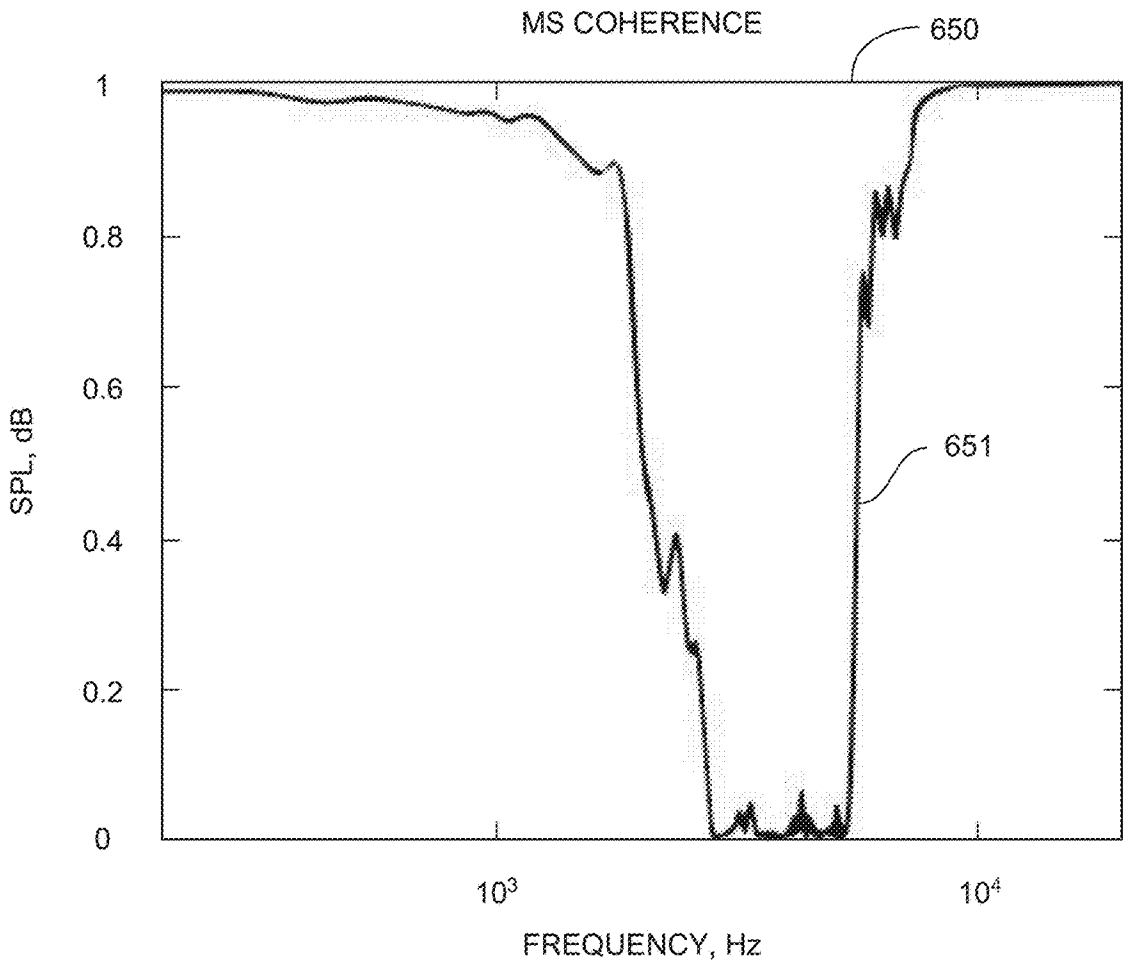
FIG. 6B is a graph of a coherence between an audio input signal and a reference point, according to various embodiments.

FIG. 6B is a graph of a coherence between an audio input signal and a reference point, according to various embodiments. As shown, graph 650 illustrates the MS coherence 651 for the given frequency range between the input audio signal X and the captured audio signal Y. Coherence computation module 320 computes MS coherence 651 for input spectrum 601 against a frequency-domain representation of the captured audio signal Y. For the frequency range between 2-7 kHz, coherence computation module 320 computes a low coherence between the input audio signal X and the captured audio signal Y.

Figure 7A:
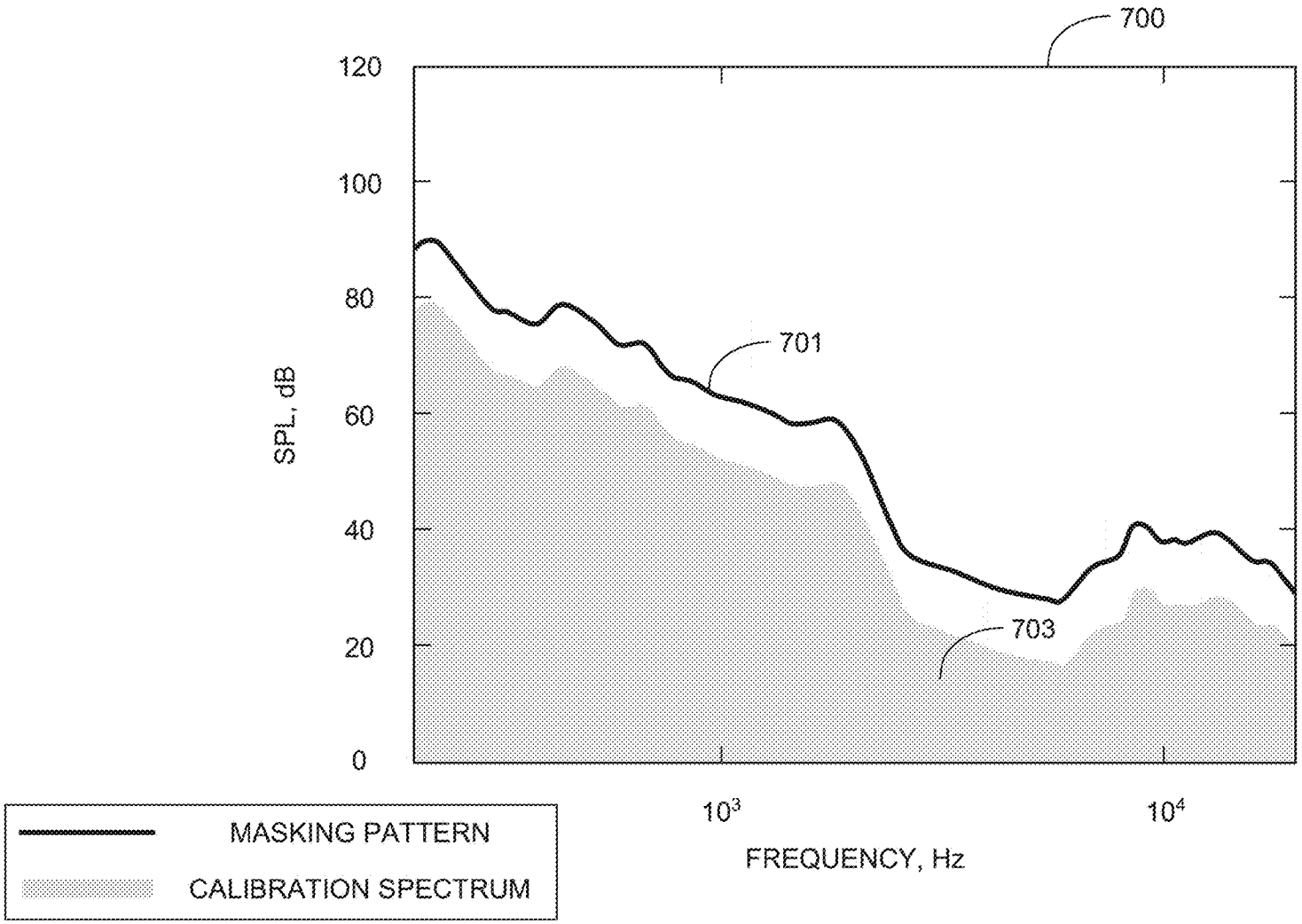
FIG. 7A is a graph of a generated inaudible spectrum associated with a masking pattern, according to various embodiments.

FIG. 7A is a graph of a generated inaudible spectrum associated with a masking pattern, according to various embodiments. Graph 700 shows an auditory masking pattern 701 and a calibration spectrum 703. During operation, calibration module 420 may generate calibration spectrum 703 based on auditory masking pattern 701.

In various embodiments, calibration module 420 may compute auditory masking pattern 701 from the input audio signal x, where auditory masking pattern 701 corresponds to auditory masking patter 603. Upon generating auditory masking pattern 701, calibration module 420 may generate a calibration signal N, where calibration spectrum 703 is the frequency-domain representation of the calibration signal n. In various embodiments, calibration module 420 generates calibration spectrum 703 such that the maximum energy of the calibration spectrum 703 remains at a threshold level below the energy level specified by auditory masking pattern 701. For example, as shown, calibration spectrum 703 has energy that is consistently f dB SPL below the energy level of auditory masking pattern 701 for the entire frequency range.

Figure 7B:
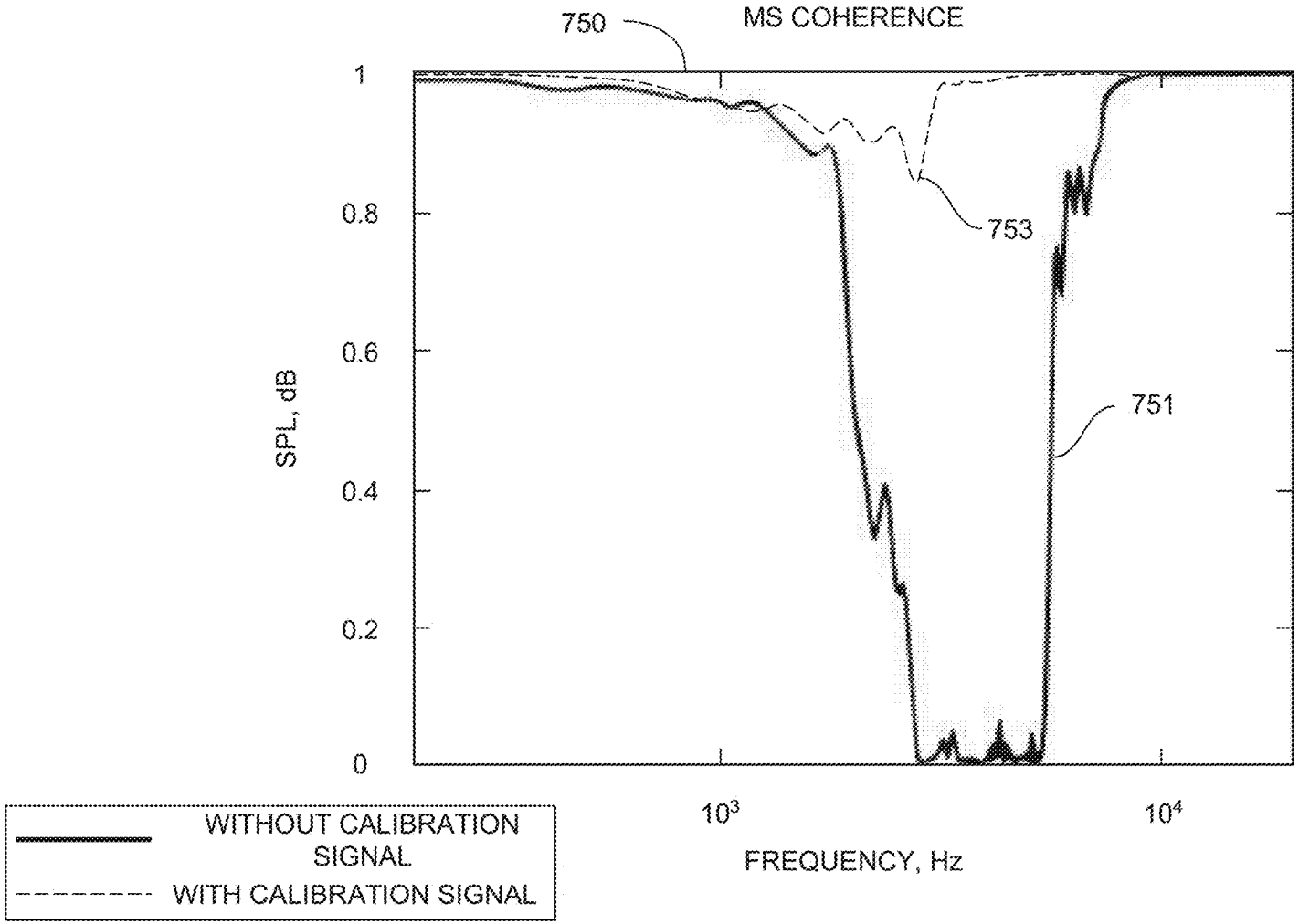
FIG. 7B is a graph of a coherence between an audio input signal including a portion of generated calibration signal and a reference point, according to various embodiments.

FIG. 7B is a graph of a coherence between an audio input signal including a portion of generated calibration signal and a reference point, according to various embodiments. As shown, graph 750 illustrates the MS coherences 751, 753 for the given frequency range between the captured audio signal Y and respective input audio signals, including the input audio signal X and the combined audio signal C.

MS coherence 751 illustrates the coherence value between a captured audio signal Y and an input audio signal X, which does not include calibration spectrum 703. MS coherence 753 illustrates the coherence value between a captured audio signal Y' and a combined audio signal C that includes calibration spectrum 703. Graph 940 illustrates that coherence computation module 450 computes MS coherence 753 between the combined signal and the captured signal that remains high for the frequency range between 2-7 kHz, even though combined audio signal C does not include an audio signal that is audible to the user within this frequency range.

Figure 8:
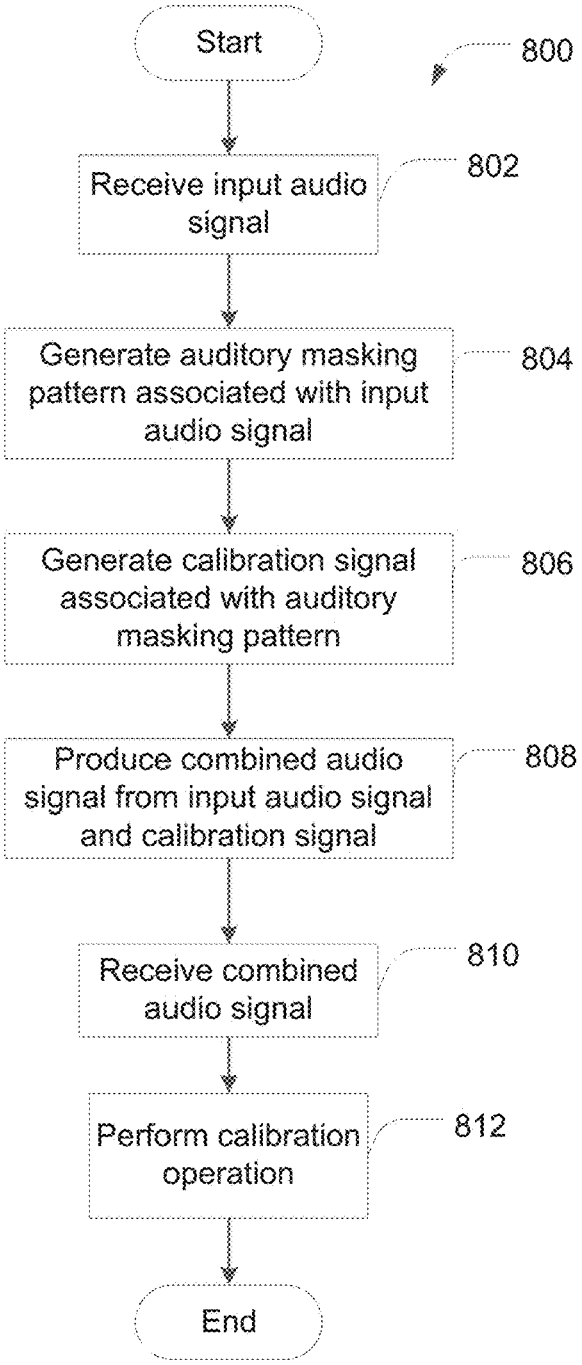
FIG. 8 is a flow diagram of method steps for calibrating for an audio system, according to various embodiments.

FIG. 8 is a flow diagram of method steps for calibrating for an audio system, according to various embodiments. Although the method steps are described with reference to the systems of FIGS. 1-7B, persons skilled in the art will understand that the method steps can be performed in any order by any system.

As shown, method 800 begins at step 802, where calibration application 200 receives an input audio signal x. In some embodiments, system identification module 240 included in calibration application 200 may receive the input audio signal x from audio system 105.

At step 804, calibration application 200 generates an auditory masking pattern associated with the input audio signal. In various embodiments, a calibration module 420 included in a system identification module 240 receives a frequency-domain representation of the input audio signal X. Calibration module 420 may measure the input audio signal and may compute an auditory masking pattern based on the input audio signal. The auditory masking pattern is a broadband auditory mask that renders inaudible other audio signals that have energies below that of the auditory masking pattern. When the input audio signal is used as a masking signal, the input audio signal provides an auditory mask. Calibration module 420 generates an auditory masking pattern that corresponds to the auditory mask provided by the input audio signal. Calibration module 420 generates an auditory masking pattern in order to generate a calibration signal N that is inaudible to a listener during playback.

At step 806, calibration application 200 generates a calibration signal associated with the auditory masking pattern. In various embodiments, calibration module 420 generates a calibration signal N that is associated with the previously-generated auditory masking pattern. For example, calibration module 420, upon generating the auditory masking pattern, can generate a calibration signal N that has a spectrum shaped such that the energy throughout a specific frequency range is set to f dB SPL below the energy of the auditory masking pattern. In some embodiments, calibration module 420 generates one or more narrowband calibration signals for specific frequency ranges associated with the input audio signal.

At step 808, calibration application 200 produces a combined audio signal from the input audio signal and the generated calibration signal. In various embodiments, combiner 430 included in system identification module 240 receives the calibration signal generated by calibration module 420 and receives the input audio signal. Combiner 430 generates a combined audio signal by injecting the calibration signal into the input audio signal. The combined audio signal may have energy throughout an entire specified frequency range for a given time frame. In various embodiments, the combined audio signal is provided to speaker 210 included in audio system 105.

In various embodiments, combiner 430 may determine one or more frequency ranges within the spectrum of the input audio signal that can include additional, inaudible signals. In such instances, combiner 430 can identify a frequency range where the auditory masking pattern has a non-zero energy, but the input audio signal does not produce audible sound. Combiner 430 can then inject a narrowband calibration signal for the specified frequency range into the input audio signal.

In various embodiments, calibration module 420 may use the auditory masking pattern to generate the calibration signal for one or more frames of the input audio signal. In such instances, combiner 430 may combine the calibration signal with multiple frames of the input audio signal. For example, combiner 430 can combine the calibration signal with a first frame of the input audio signal. Combiner 430 can also combine the generated calibration signal with a second frame of the input audio signal. The second frame may be a frame of audio subsequent to the first frame within the same audio input.

At step 810, microphone 220 receives the combined audio signal. In various embodiments, calibration application 200 may receive the combined audio signal as from audio system 105 via microphone 220. Microphone 220 may generate a captured audio signal in response to receiving the combined audio signal as a physical audio signal produced by speaker 210. In various embodiments, the captured audio signal is a reproduction of the combined audio signal, where the combined audio signal includes the input audio signal and in the injected calibration signal. Microphone 220 receives the calibration signal included in the combined audio signal, even though the calibration signal is inaudible to the listener, as the energy of the calibration signal is below the energy of the auditory masking pattern provided by the input audio signal. Because microphone 220 receives the combined audio signal that includes energy throughout the entire specified frequency range, calibration application 200 may maintain high input/output coherence continually.

At step 812, calibration application 200 performs a calibration operation based on a coherence between the combined audio signal and the captured audio signal. In various embodiments, estimated transfer function computation module 450 included in system identification module 240 generates an estimated transfer function based on the combined audio signal and the captured audio signal. The estimated transfer function estimates the input/output relationship between the combined audio signal, as produced by speaker 210, and the captured audio signal, as recorded by microphone 220.

In some embodiments, calibration application 200 may calibrate the combined audio signal based on sub-band representations of the combined audio signal. For example, a sub-band operation module 370 included in system identification module 240 decomposes a time the input audio signal x into k sub-band signals $X_k$, and decomposes the captured audio signal y into k sub-band signals $Y_k$. In such instances, system identification module 240 may generate k narrowband calibration signals $N_k$ and may generate corresponding sub-band combined signals $N_k$.

EQ module 250 receives the estimated transfer function and derives an equalization filter 260 for the combined audio signal based on the estimated transfer function. In various embodiments, equalization filter 260 is a broadband and/or one or more narrowband filters that adjust the frequency components of the combined audio signal for a specific frequency range.

The Artificial Reality System

Embodiments of the disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) or near-eye display (NED) connected to a host computer system, a standalone HMD or NED, a mobile device or computing system, or any other hardware platform capable of providing artificial reality content to one or more viewers.

Figure 9:
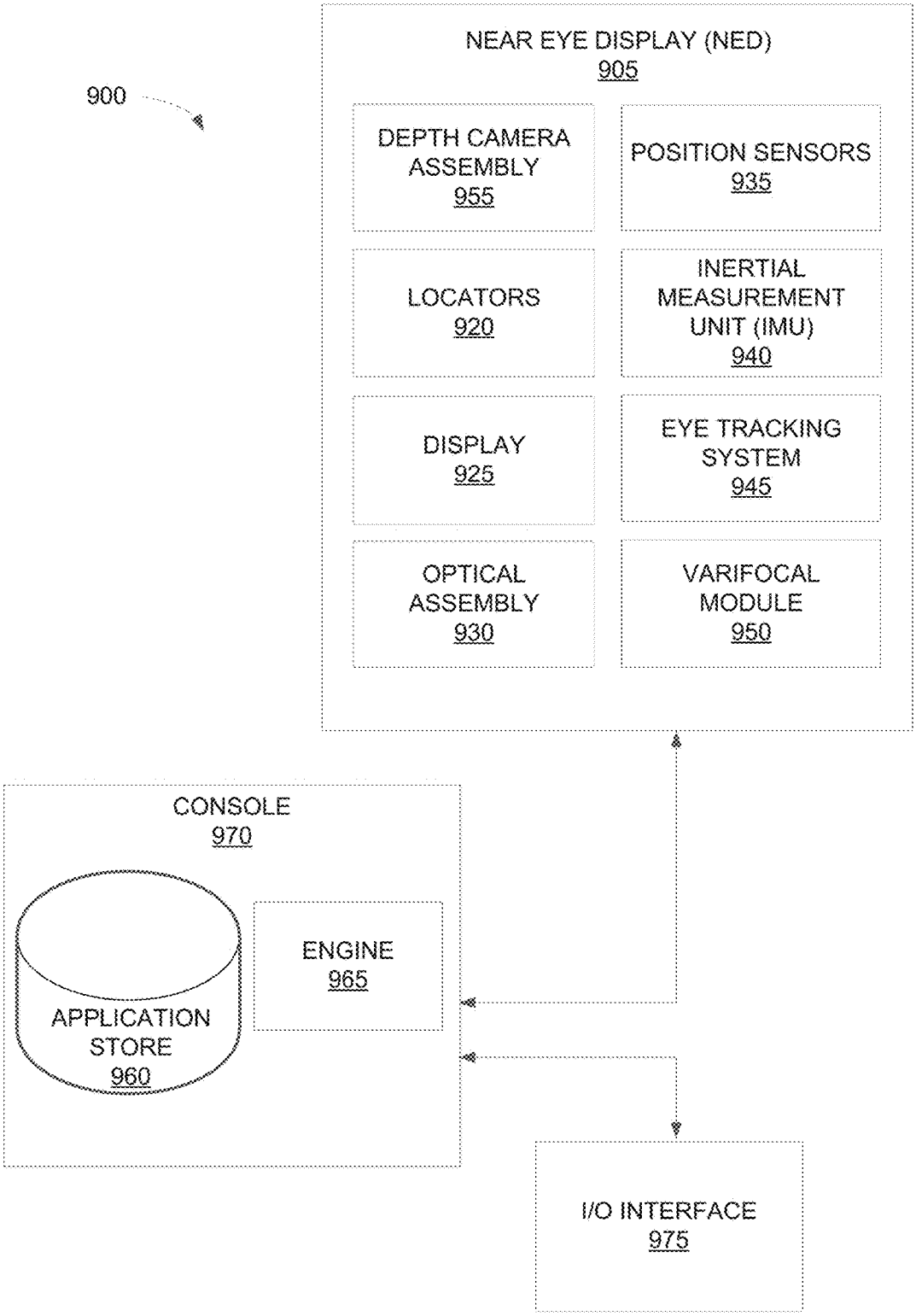
FIG. 9 is a block diagram of an embodiment of a near-eye display (NED) system in which a console operates, according to various embodiments.

FIG. 9 is a block diagram of an embodiment of a near eye display (NED) system 900 in which a console 970 operates. The NED system 900 may operate in a virtual reality (VR) system environment, an augmented reality (AR) system environment, a mixed reality (MR) system environment, or some combination thereof. The NED system 900 shown in FIG. 9 comprises a NED 905 and an input/output (I/O) interface 975 that is coupled to the console 970. In various embodiments, the audio system 105 is included in or operates in conjunction with the NED system 900. For example, the audio system 105 may be included within NED 905 or may be coupled to the console 970 and/or the NED 905. Further, the application 140 may execute on the console 970 or within the NED 905.

While FIG. 9 shows an example NED system 900 including one NED 905 and one I/O interface 975, in other embodiments any number of these components may be included in the NED system 900. For example, there may be multiple NEDs 905, and each NED 905 has an associated I/O interface 975. Each NED 905 and I/O interface 975 communicates with the console 970. In alternative configurations, different and/or additional components may be included in the NED system 900. Additionally, various components included within the NED 905, the console 970, and the I/O interface 975 may be distributed in a different manner than is described in conjunction with FIGS. 1-6 in some embodiments. For example, some or all of the functionality of the console 970 may be provided by the NED 905 and vice versa.

The NED 905 may be a head-mounted display that presents content to a user. The content may include virtual and/or augmented views of a physical, real-world environment including computer-generated elements (e.g., two-dimensional or three-dimensional images, two-dimensional or three-dimensional video, sound, etc.). In some embodiments, the NED 905 may also present audio content to a user. The NED 905 and/or the console 970 may transmit the audio content to an external device via the I/O interface 975. The external device may include various forms of speaker systems and/or headphones. In various embodiments, the audio content is synchronized with visual content being displayed by the NED 905.

The NED 905 may comprise one or more rigid bodies, which may be rigidly or non-rigidly coupled together. A rigid coupling between rigid bodies causes the coupled rigid bodies to act as a single rigid entity. In contrast, a non-rigid coupling between rigid bodies allows the rigid bodies to move relative to each other.

As shown in FIG. 9, the NED 905 may include a depth camera assembly (DCA) 955, one or more locators 920, a display 925, an optical assembly 930, one or more position sensors 935, an inertial measurement unit (IMU) 940, an eye tracking system 945, and a varifocal module 950. In some embodiments, the display 925 and the optical assembly 930 can be integrated together into a projection assembly. Various embodiments of the NED 905 may have additional, fewer, or different components than those listed above. Additionally, the functionality of each component may be partially or completely encompassed by the functionality of one or more other components in various embodiments.

The DCA 955 captures sensor data describing depth information of an area surrounding the NED 905. The sensor data may be generated by one or a combination of depth imaging techniques, such as triangulation, structured light imaging, time-of-flight imaging, stereo imaging, laser scan, and so forth. The DCA 955 can compute various depth properties of the area surrounding the NED 905 using the sensor data. Additionally or alternatively, the DCA 955 may transmit the sensor data to the console 970 for processing. Further, in various embodiments, the DCA 955 captures or samples sensor data at different times. For example, the DCA 955 could sample sensor data at different times within a time window to obtain sensor data along a time dimension.

The DCA 955 includes an illumination source, an imaging device, and a controller. The illumination source emits light onto an area surrounding the NED 905. In an embodiment, the emitted light is structured light. The illumination source includes a plurality of emitters that each emits light having certain characteristics (e.g., wavelength, polarization, coherence, temporal behavior, etc.). The characteristics may be the same or different between emitters, and the emitters can be operated simultaneously or individually. In one embodiment, the plurality of emitters could be, e.g., laser diodes (such as edge emitters), inorganic or organic light-emitting diodes (LEDs), a vertical-cavity surface-emitting laser (VCSEL), or some other source. In some embodiments, a single emitter or a plurality of emitters in the illumination source can emit light having a structured light pattern. The imaging device captures ambient light in the environment surrounding NED 905, in addition to light reflected off of objects in the environment that is generated by the plurality of emitters. In various embodiments, the imaging device may be an infrared camera or a camera configured to operate in a visible spectrum. The controller coordinates how the illumination source emits light and how the imaging device captures light. For example, the controller may determine a brightness of the emitted light. In some embodiments, the controller also analyzes detected light to detect objects in the environment and position information related to those objects.

The locators 920 are objects located in specific positions on the NED 905 relative to one another and relative to a specific reference point on the NED 905. A locator 920 may be a light emitting diode (LED), a corner cube reflector, a reflective marker, a type of light source that contrasts with an environment in which the NED 905 operates, or some combination thereof. In embodiments where the locators 920 are active (i.e., an LED or other type of light emitting device), the locators 920 may emit light in the visible band (~380 nm to 950 nm), in the infrared (IR) band (~950 nm to 9700 nm), in the ultraviolet band (70 nm to 380 nm), some other portion of the electromagnetic spectrum, or some combination thereof.

In some embodiments, the locators 920 are located beneath an outer surface of the NED 905, which is transparent to the wavelengths of light emitted or reflected by the locators 920 or is thin enough not to substantially attenuate the wavelengths of light emitted or reflected by the locators 920. Additionally, in some embodiments, the outer surface or other portions of the NED 905 are opaque in the visible band of wavelengths of light. Thus, the locators 920 may emit light in the IR band under an outer surface that is transparent in the IR band but opaque in the visible band.

The display 925 displays two-dimensional or three-dimensional images to the user in accordance with pixel data received from the console 970 and/or one or more other sources. In various embodiments, the display 925 comprises a single display or multiple displays (e.g., separate displays for each eye of a user). In some embodiments, the display 925 comprises a single or multiple waveguide displays. Light can be coupled into the single or multiple waveguide displays via, e.g., a liquid crystal display (LCD), an organic light emitting diode (OLED) display, an inorganic light emitting diode (ILED) display, an active-matrix organic light-emitting diode (AMOLED) display, a transparent organic light emitting diode (TOLED) display, a laser-based display, one or more waveguides, other types of displays, a scanner, a one-dimensional array, and so forth. In addition, combinations of the displays types may be incorporated in display 925 and used separately, in parallel, and/or in combination.

The optical assembly 930 magnifies image light received from the display 925, corrects optical errors associated with the image light, and presents the corrected image light to a user of the NED 905. The optical assembly 930 includes a plurality of optical elements. For example, one or more of the following optical elements may be included in the optical assembly 930: an aperture, a Fresnel lens, a convex lens, a concave lens, a filter, a reflecting surface, or any other suitable optical element that deflects, reflects, refracts, and/or in some way alters image light. Moreover, the optical assembly 930 may include combinations of different optical elements. In some embodiments, one or more of the optical elements in the optical assembly 930 may have one or more coatings, such as partially reflective or antireflective coatings.

In some embodiments, the optical assembly 930 may be designed to correct one or more types of optical errors. Examples of optical errors include barrel or pincushion distortions, longitudinal chromatic aberrations, or transverse chromatic aberrations. Other types of optical errors may further include spherical aberrations, chromatic aberrations or errors due to the lens field curvature, astigmatisms, in addition to other types of optical errors. In some embodiments, visual content transmitted to the display 925 is pre-distorted, and the optical assembly 930 corrects the distortion as image light from the display 925 passes through various optical elements of the optical assembly 930. In some embodiments, optical elements of the optical assembly 930 are integrated into the display 925 as a projection assembly that includes at least one waveguide coupled with one or more optical elements.

The IMU 940 is an electronic device that generates data indicating a position of the NED 905 based on measurement signals received from one or more of the position sensors 935 and from depth information received from the DCA 955. In some embodiments of the NED 905, the IMU 940 may be a dedicated hardware component. In other embodiments, the IMU 940 may be a software component implemented in one or more processors.

In operation, a position sensor 935 generates one or more measurement signals in response to a motion of the NED 905. Examples of position sensors 935 include: one or more accelerometers, one or more gyroscopes, one or more magnetometers, one or more altimeters, one or more inclinometers, and/or various types of sensors for motion detection, drift detection, and/or error detection. The position sensors 935 may be located external to the IMU 940, internal to the IMU 940, or some combination thereof.

Based on the one or more measurement signals from one or more position sensors 935, the IMU 940 generates data indicating an estimated current position of the NED 905 relative to an initial position of the NED 905. For example, the position sensors 935 include multiple accelerometers to measure translational motion (forward/back, up/down, left/right) and multiple gyroscopes to measure rotational motion (e.g., pitch, yaw, and roll). In some embodiments, the IMU 940 rapidly samples the measurement signals and calculates the estimated current position of the NED 905 from the sampled data. For example, the IMU 940 integrates the measurement signals received from the accelerometers over time to estimate a velocity vector and integrates the velocity vector over time to determine an estimated current position of a reference point on the NED 905. Alternatively, the IMU 940 provides the sampled measurement signals to the console 970, which analyzes the sample data to determine one or more measurement errors. The console 970 may further transmit one or more of control signals and/or measurement errors to the IMU 940 to configure the IMU 940 to correct and/or reduce one or more measurement errors (e.g., drift errors). The reference point is a point that may be used to describe the position of the NED 905. The reference point may generally be defined as a point in space or a position related to a position and/or orientation of the NED 905.

In various embodiments, the IMU 940 receives one or more parameters from the console 970. The one or more parameters are used to maintain tracking of the NED 905. Based on a received parameter, the IMU 940 may adjust one or more IMU parameters (e.g., a sample rate). In some embodiments, certain parameters cause the IMU 940 to update an initial position of the reference point so that it corresponds to a next position of the reference point. Updating the initial position of the reference point as the next calibrated position of the reference point helps reduce drift errors in detecting a current position estimate of the IMU 940.

In various embodiments, the eye tracking system 945 is integrated into the NED 905. The eye-tracking system 945 may comprise one or more illumination sources (e.g., infrared illumination source, visible light illumination source) and one or more imaging devices (e.g., one or more cameras). In operation, the eye tracking system 945 generates and analyzes tracking data related to a user's eyes as the user wears the NED 905. In various embodiments, the eye tracking system 945 estimates the angular orientation of the user's eye. The orientation of the eye corresponds to the direction of the user's gaze within the NED 905. The orientation of the user's eye is defined herein as the direction of the foveal axis, which is the axis between the fovea (an area on the retina of the eye with the highest concentration of photoreceptors) and the center of the eye's pupil. In general, when a user's eyes are fixed on a point, the foveal axes of the user's eyes intersect that point. The pupillary axis is another axis of the eye that is defined as the axis passing through the center of the pupil and that is perpendicular to the corneal surface. The pupillary axis does not, in general, directly align with the foveal axis. Both axes intersect at the center of the pupil, but the orientation of the foveal axis is offset from the pupillary axis by approximately −1° to 8° laterally and ±4° vertically. Because the foveal axis is defined according to the fovea, which is located in the back of the eye, the foveal axis can be difficult or impossible to detect directly in some eye tracking embodiments. Accordingly, in some embodiments, the orientation of the pupillary axis is detected and the foveal axis is estimated based on the detected pupillary axis.

In general, movement of an eye corresponds not only to an angular rotation of the eye, but also to a translation of the eye, a change in the torsion of the eye, and/or a change in shape of the eye. The eye tracking system 945 may also detect translation of the eye, i.e., a change in the position of the eye relative to the eye socket. In some embodiments, the translation of the eye is not detected directly, but is approximated based on a mapping from a detected angular orientation. Translation of the eye corresponding to a change in the eye's position relative to the detection components of the eye tracking unit may also be detected. Translation of this type may occur, for example, due to a shift in the position of the NED 905 on a user's head. The eye tracking system 945 may also detect the torsion of the eye, i.e., rotation of the eye about the pupillary axis. The eye tracking system 945 may use the detected torsion of the eye to estimate the orientation of the foveal axis from the pupillary axis. The eye tracking system 945 may also track a change in the shape of the eye, which may be approximated as a skew or scaling linear transform or a twisting distortion (e.g., due to torsional deformation). The eye tracking system 945 may estimate the foveal axis based on some combination of the angular orientation of the pupillary axis, the translation of the eye, the torsion of the eye, and the current shape of the eye.

As the orientation may be determined for both eyes of the user, the eye tracking system 945 is able to determine where the user is looking. The NED 905 can use the orientation of the eye to, e.g., determine an inter-pupillary distance (IPD) of the user, determine gaze direction, introduce depth cues (e.g., blur image outside of the user's main line of sight), collect heuristics on the user interaction in the VR media (e.g., time spent on any particular subject, object, or frame as a function of exposed stimuli), some other function that is based in part on the orientation of at least one of the user's eyes, or some combination thereof. Determining a direction of a user's gaze may include determining a point of convergence based on the determined orientations of the user's left and right eyes. A point of convergence may be the point that the two foveal axes of the user's eyes intersect (or the nearest point between the two axes). The direction of the user's gaze may be the direction of a line through the point of convergence and though the point halfway between the pupils of the user's eyes.

In some embodiments, the varifocal module 950 is integrated into the NED 905. The varifocal module 950 may be communicatively coupled to the eye tracking system 945 in order to enable the varifocal module 950 to receive eye tracking information from the eye tracking system 945. The varifocal module 950 may further modify the focus of image light emitted from the display 925 based on the eye tracking information received from the eye tracking system 945. Accordingly, the varifocal module 950 can reduce vergence-accommodation conflict that may be produced as the user's eyes resolve the image light. In various embodiments, the varifocal module 950 can be interfaced (e.g., either mechanically or electrically) with at least one optical element of the optical assembly 930.

In operation, the varifocal module 950 may adjust the position and/or orientation of one or more optical elements in the optical assembly 930 in order to adjust the focus of image light propagating through the optical assembly 930. In various embodiments, the varifocal module 950 may use eye tracking information obtained from the eye tracking system 945 to determine how to adjust one or more optical elements in the optical assembly 930. In some embodiments, the varifocal module 950 may perform foveated rendering of the image light based on the eye tracking information obtained from the eye tracking system 945 in order to adjust the resolution of the image light emitted by the display 925. In this case, the varifocal module 950 configures the display 925 to display a high pixel density in a foveal region of the user's eye-gaze and a low pixel density in other regions of the user's eye-gaze.

The I/O interface 975 facilitates the transfer of action requests from a user to the console 970. In addition, the I/O interface 975 facilitates the transfer of device feedback from the console 970 to the user. An action request is a request to perform a particular action. For example, an action request may be an instruction to start or end capture of image or video data or an instruction to perform a particular action within an application, such as pausing video playback, increasing or decreasing the volume of audio playback, and so forth. In various embodiments, the I/O interface 975 may include one or more input devices. Example input devices include: a keyboard, a mouse, a game controller, a joystick, and/or any other suitable device for receiving action requests and communicating the action requests to the console 970. In some embodiments, the I/O interface 975 includes an IMU 940 that captures calibration data indicating an estimated current position of the I/O interface 975 relative to an initial position of the I/O interface 975.

In operation, the I/O interface 975 receives action requests from the user and transmits those action requests to the console 970. Responsive to receiving the action request, the console 970 performs a corresponding action. For example, responsive to receiving an action request, console 970 may configure I/O interface 975 to emit haptic feedback onto an arm of the user. For example, console 975 may configure I/O interface 975 to deliver haptic feedback to a user when an action request is received. Additionally or alternatively, the console 970 may configure the I/O interface 975 to generate haptic feedback when the console 970 performs an action, responsive to receiving an action request.

The console 970 provides content to the NED 905 for processing in accordance with information received from one or more of: the DCA 955, the eye tracking system 945, one or more other components of the NED 905, and the I/O interface 975. In the embodiment shown in FIG. 9, the console 970 includes an application store 960 and an engine 965. In some embodiments, the console 970 may have additional, fewer, or different modules and/or components than those described in conjunction with FIG. 9. Similarly, the functions further described below may be distributed among components of the console 970 in a different manner than described in conjunction with FIG. 9.

The application store 960 stores one or more applications for execution by the console 970. An application is a group of instructions that, when executed by a processor, performs a particular set of functions, such as generating content for presentation to the user. For example, an application may generate content in response to receiving inputs from a user (e.g., via movement of the NED 905 as the user moves his/her head, via the I/O interface 975, etc.). Examples of applications include: gaming applications, conferencing applications, video playback applications, or other suitable applications.

In some embodiments, the engine 965 generates a three-dimensional mapping of the area surrounding the NED 905 (i.e., the "local area") based on information received from the NED 905. In some embodiments, the engine 965 determines depth information for the three-dimensional mapping of the local area based on depth data received from the NED 905. In various embodiments, the engine 965 uses depth data received from the NED 905 to update a model of the local area and to generate and/or modify media content based in part on the updated model of the local area.

The engine 965 also executes applications within the NED system 900 and receives position information, acceleration information, velocity information, predicted future positions, or some combination thereof, of the NED 905. Based on the received information, the engine 965 determines various forms of media content to transmit to the NED 905 for presentation to the user. For example, if the received information indicates that the user has looked to the left, the engine 965 generates media content for the NED 905 that mirrors the user's movement in a virtual environment or in an environment augmenting the local area with additional media content. Accordingly, the engine 965 may generate and/or modify media content (e.g., visual and/or audio content) for presentation to the user. The engine 965 may further transmit the media content to the NED 905. Additionally, in response to receiving an action request from the I/O interface 975, the engine 965 may perform an action within an application executing on the console 970. The engine 965 may further provide feedback when the action is performed. For example, the engine 965 may configure the NED 905 to generate visual and/or audio feedback and/or the I/O interface 975 to generate haptic feedback to the user.

In some embodiments, based on the eye tracking information (e.g., orientation of the user's eye) received from the eye tracking system 945, the engine 965 determines a resolution of the media content provided to the NED 905 for presentation to the user on the display 925. The engine 965 may adjust a resolution of the visual content provided to the NED 905 by configuring the display 925 to perform foveated rendering of the visual content, based at least in part on a direction of the user's gaze received from the eye tracking system 945. The engine 965 provides the content to the NED 905 having a high resolution on the display 925 in a foveal region of the user's gaze and a low resolution in other regions, thereby reducing the power consumption of the NED 905. In addition, using foveated rendering reduces a number of computing cycles used in rendering visual content without compromising the quality of the user's visual experience. In some embodiments, the engine 965 can further use the eye tracking information to adjust a focus of the image light emitted from the display 925 in order to reduce vergence-accommodation conflicts.

Figure 10A:
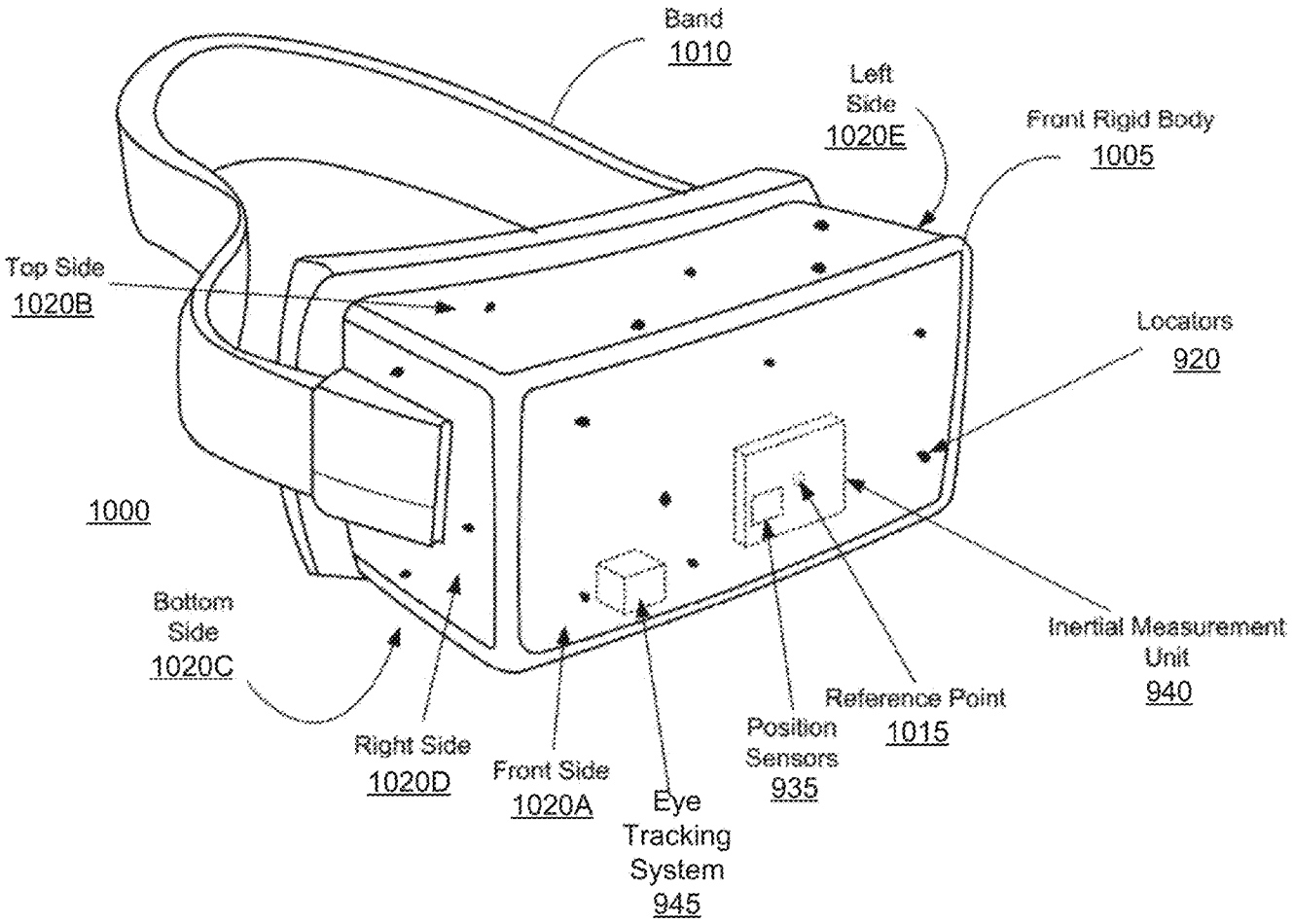
FIG. 10A is a diagram of an NED, according to various embodiments.

FIG. 10A is a diagram of an NED 1000, according to various embodiments. In various embodiments, NED 1000 presents media to a user. The media may include visual, auditory, and haptic content. In some embodiments, NED 1000 provides artificial reality (e.g., virtual reality) content by providing a real-world environment and/or computer-generated content. In some embodiments, the computer-generated content may include visual, auditory, and haptic information. The NED 1000 is an embodiment of the NED 905 and includes a front rigid body 1005 and a band 1010.

The front rigid body 1005 includes an electronic display element of the electronic display 925 (not shown in FIG. 10A), the optics assembly 930 (not shown in FIG. 10A), the IMU 940, the one or more position sensors 935, the eye tracking system 945, and the locators 920. In the embodiment shown by FIG. 10A, the position sensors 935 are located within the IMU 940, and neither the IMU 940 nor the position sensors 935 are visible to the user.

The locators 920 are located in fixed positions on the front rigid body 1005 relative to one another and relative to a reference point 1015. In the example of FIG. 10A, the reference point 1015 is located at the center of the IMU 940. Each of the locators 920 emits light that is detectable by the imaging device in the DCA 955. The locators 920, or portions of the locators 920, are located on a front side 1020A, a top side 1020B, a bottom side 1020C, a right side 1020D, and a left side 1020E of the front rigid body 1005 in the example of FIG. 10A.

The NED 1000 includes the eye tracking system 945. As discussed above, the eye tracking system 945 may include a structured light generator that projects an interferometric structured light pattern onto the user's eye and a camera to detect the illuminated portion of the eye. The structured light generator and the camera may be located off the axis of the user's gaze. In various embodiments, the eye tracking system 945 may include, additionally or alternatively, one or more time-of-flight sensors and/or one or more stereo depth sensors. In FIG. 10A, the eye tracking system 945 is located below the axis of the user's gaze, although the eye tracking system 945 can alternately be placed elsewhere. Also, in some embodiments, there is at least one eye tracking unit for the left eye of the user and at least one tracking unit for the right eye of the user.

In various embodiments, the eye tracking system 945 includes one or more cameras on the inside of the NED 1000. The camera(s) of the eye tracking system 945 may be directed inwards, toward one or both eyes of the user while the user is wearing the NED 1000, so that the camera(s) may image the eye(s) and eye region(s) of the user wearing the NED 1000. The camera(s) may be located off the axis of the user's gaze. In some embodiments, the eye tracking system 945 includes separate cameras for the left eye and the right eye (e.g., one or more cameras directed toward the left eye of the user and, separately, one or more cameras directed toward the right eye of the user).

Figure 10B:
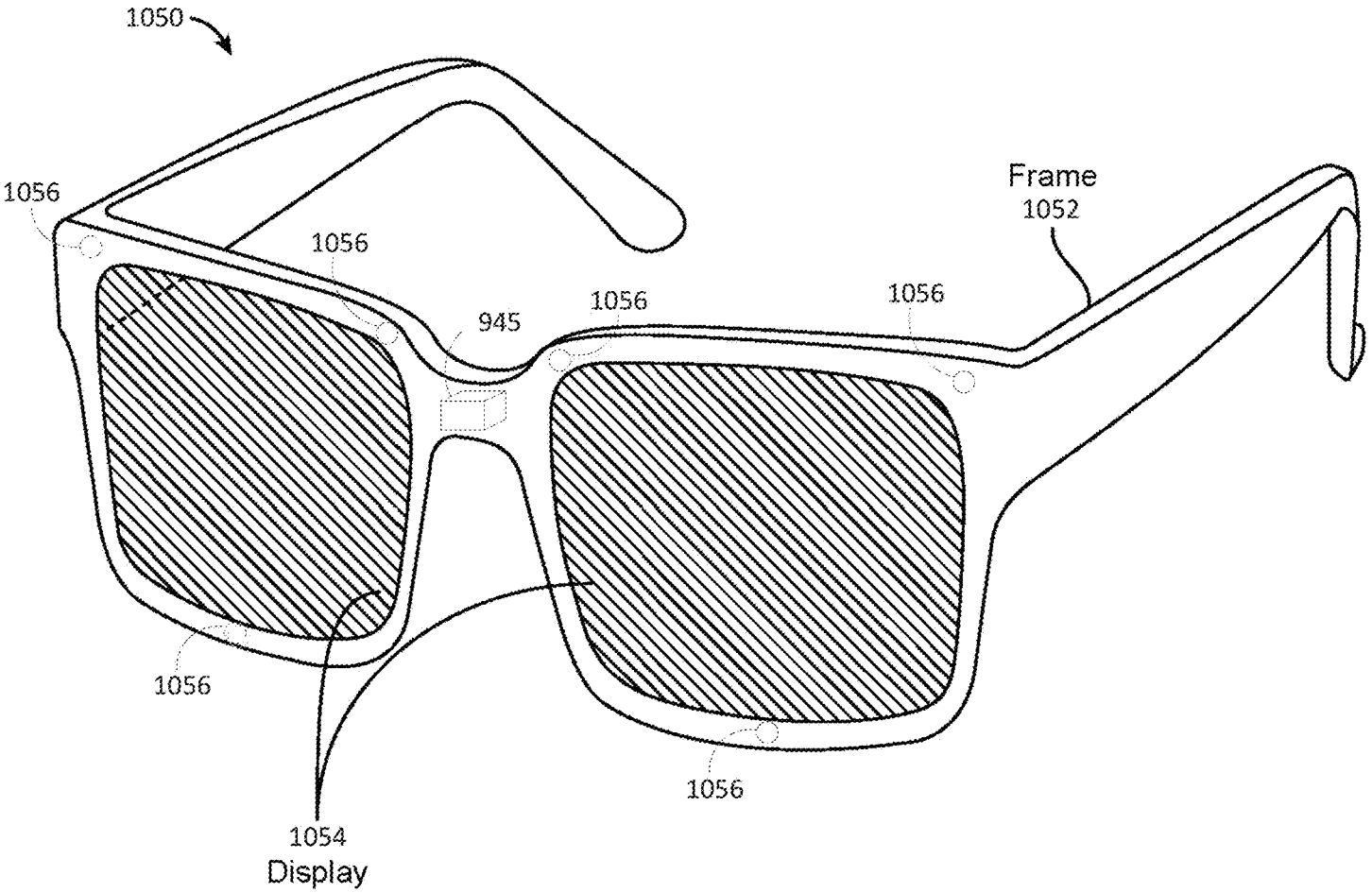
FIG. 10B is another diagram of an NED, according to various embodiments.

FIG. 10B is a diagram of an NED 1050, according to various embodiments. In various embodiments, NED 1050 presents media to a user. The media may include visual, auditory, and haptic content. In some embodiments, NED 1050 provides artificial reality (e.g., augmented reality) content by providing a real-world environment and/or computer-generated content. In some embodiments, the computer-generated content may include visual, auditory, and haptic information. The NED 1000 is an embodiment of the NED 905.

NED 1050 includes frame 1052 and display 1054. In various embodiments, the NED 1050 may include one or more additional elements. Display 1054 may be positioned at different locations on the NED 250 than the locations illustrated in FIG. 10B. Display 1054 is configured to provide content to the user, including audiovisual content. In some embodiments, one or more displays 1054 may be located within frame 1052.

NED 1050 further includes eye tracking system 945 and one or more corresponding modules 1056. The modules 1056 may include emitters (e.g., light emitters) and/or sensors (e.g., image sensors, cameras). In various embodiments, the modules 1056 are arranged at various positions along the inner surface of the frame 1052, so that the modules 1056 are facing the eyes of a user wearing the NED 1050. For example, the modules 1056 could include emitters that emit structured light patterns onto the eyes and image sensors to capture images of the structured light pattern on the eyes. As another example, the modules 1056 could include multiple time-of-flight sensors for directing light at the eyes and measuring the time of travel of the light at each pixel of the sensors. As a further example, the modules 1056 could include multiple stereo depth sensors for capturing images of the eyes from different vantage points. In various embodiments, the modules 1056 also include image sensors for capturing 2D images of the eyes.

In sum, various embodiments set forth techniques and system architecture that enable a computing device to continually calibrate an audio signal. A computing device includes a calibration application that receives an input audio signal. The calibration device includes a system identification module that generates an auditory masking pattern associated with the input audio signal acting as an auditory mask for other audio signals. The system identification module generates a calibration signal that is inaudible due to the auditory masking pattern of the input audio signal. The system identification module combines the calibration signal with the input audio signal to produce a combined audio signal. The calibration signal included in the combined audio signal remains inaudible to a listener during playback because the input audio signal masks the calibration signal. A microphone records a captured audio signal in response to a speaker providing a playback of the combined audio signal, which includes the calibration signal. The system identification module then generates an estimated transfer function between the combined audio signal and the captured audio signal. In various embodiments, the calibration application includes an equalization module that generates a filter that adjusts the captured audio signal based on the estimated transfer function.

At least one advantage of the disclosed embodiments is that the calibration application is able to add a specific calibration signal to an input audio signal based on an auditory masking pattern associated with the input signal. Adding the specific calibration signal below the levels of the auditory masking pattern enables the calibration signal to be included with the input audio signal during playback while remaining inaudible to the listener. Including an inaudible calibration signal with the input audio signal during playback enables the system to record a captured audio signal that includes the calibration signal, which ensures a high coherence between the combined signal and the captured audio signal throughout a broadband frequency range. A high coherence between the combined signal and the captured audio signal enables the calibration system to provide a filter that effectively adjusts the input audio signal.

The disclosed embodiments provide a technological improvement in that an audio system may provide neutral audio reproduction and may work properly independently of the audio source material and the amount of background noise.

1. In some embodiments, a method comprises generating a first auditory masking pattern based on a frequency spectrum of at least a first frame of a first audio signal, generating a first calibration signal based on the first auditory masking pattern, producing a combined input signal based on the first audio signal and the first calibration signal, and performing one or more calibration operations based on the combined input signal.

2. The method of clause 1, further comprising providing the combined input signal to a speaker device, and receiving, from a microphone device, a second audio signal corresponding to the combined input signal, where the one or more calibration operations are performed based on a coherence between the combined input signal and the second audio signal.

3. The method of clause 1 or 2, where the first calibration signal is generated to maintain a threshold coherence between the combined input signal and the second audio signal.

4. The method of any of clauses 1-3, where the microphone device and the speaker device are included in a system configured for augmented reality or virtual reality, wherein the system further includes a display source.

5. The method of any of clauses 1-4, where the first audio signal has a first coherence with a second audio signal, the combined input signal has a second coherence with the second audio signal, and the second coherence is larger than the first coherence.

6. The method of any of clauses 1-5, where the first calibration signal comprises a narrowband calibration signal, and a frequency range of the narrowband calibration signal is based on the first audio signal.

7. The method of any of clauses 1-6, where producing the combined input signal comprises combining the first frame of the first audio signal with the first calibration signal.

8. The method of any of clauses 1-7, where producing the combined input signal comprises combining a second frame of the first audio signal with the first calibration signal.

9. The method of any of clauses 1-8, where the first audio signal attenuates at least a portion of the first calibration signal.

10. The method of any of clauses 1-9, where the combined input signal comprises a stationary broadband signal.

11. The method of any of clauses 1-10, where the one or more calibration operations comprises computing a transfer function between the combined input signal and a second audio signal corresponding to the combined input signal.

12. In some embodiments, one or more non-transitory computer readable media stores instructions that, when executed by one or more processors, cause the one or more processors to perform the steps of generating a first auditory masking pattern based on a frequency spectrum of at least a first frame of a first audio signal, generating a first calibration signal based on the first auditory masking pattern, producing a combined input signal based on the first audio signal and the first calibration signal, and performing one or more calibration operations based on the combined input signal.

13. The one or more non-transitory computer readable media of clause 12, further comprising providing the combined input signal to a speaker device, and receiving, from a microphone device, a second audio signal corresponding to the combined input signal, where the one or more calibration operations are performed based on a coherence between the combined input signal and the second audio signal.

14. The one or more non-transitory computer readable media of clause 12 or 13, where the first calibration signal is generated to maintain a threshold coherence between the combined input signal and the second audio signal.

15. The one or more non-transitory computer readable media of any of clauses 12-14, where the microphone device and the speaker device are included in a system configured for augmented reality or virtual reality, wherein the system further includes a display source.

16. The one or more non-transitory computer readable media of any of clauses 12-15, where the first audio signal has a first coherence with a second audio signal, the combined input signal has a second coherence with the second audio signal, and the second coherence is larger than the first coherence.

17. The one or more non-transitory computer readable media of any of clauses 12-16, where producing the combined input signal comprises combining the first frame of the first audio signal with the first calibration signal.

18. The one or more non-transitory computer readable media of any of clauses 12-17, where producing the combined input signal comprises combining a second frame of the first audio signal with the first calibration signal.

19. The one or more non-transitory computer readable media of any of clauses 12-18, where the first audio signal attenuates at least a portion of the first calibration signal.

20. In some embodiments, a system comprises a calibration module that generates a first auditory masking pattern based on a frequency spectrum of at least a first frame of a first audio signal, generates a first calibration signal based on the first auditory masking pattern, produces a combined input signal based on the first audio signal and the first calibration signal, and performs one or more calibration operations based on the combined input signal.

21. The system of clause 20, further comprising a microphone device, a speaker device, and a display source configured for augmented reality or virtual reality.

Any and all combinations of any of the claim elements recited in any of the claims and/or any elements described in this application, in any fashion, fall within the contemplated scope of the present invention and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." In addition, any hardware and/or software technique, process, function, component, engine, module, or system described in the present disclosure may be implemented as a circuit or set of circuits. Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A method, comprising:

generating a first auditory masking pattern based on a frequency spectrum of at least a first frame of a first audio signal;

generating a first calibration signal based on the first auditory masking pattern;

producing a combined input signal based on the first audio signal and the first calibration signal; and performing one or more calibration operations based on the combined input signal.

2. The method of claim 1, further comprising:

providing the combined input signal to a speaker device; and receiving, from a microphone device, a second audio signal corresponding to the combined input signal, wherein the one or more calibration operations are performed based on a coherence between the combined input signal and the second audio signal.

3. The method of claim 2, wherein the first calibration signal is generated to maintain a threshold coherence between the combined input signal and the second audio signal.

4. The method of claim 2, wherein the microphone device and the speaker device are included in a system configured for augmented reality or virtual reality, wherein the system further includes a display source.

5. The method of claim 1, wherein the first audio signal has a first coherence with a second audio signal, the combined input signal has a second coherence with the second audio signal, and the second coherence is larger than the first coherence.

6. The method of claim 1, wherein the first calibration signal comprises a narrowband calibration signal, and a frequency range of the narrowband calibration signal is based on the first audio signal.

7. The method of claim 1, wherein producing the combined input signal comprises combining the first frame of the first audio signal with the first calibration signal.

8. The method of claim 1, wherein producing the combined input signal comprises combining a second frame of the first audio signal with the first calibration signal.

9. The method of claim 1, wherein the first audio signal attenuates at least a portion of the first calibration signal.

10. The method of claim 1, wherein the combined input signal comprises a stationary broadband signal.

11. The method of claim 1, wherein the one or more calibration operations comprises computing a transfer function between the combined input signal and a second audio signal corresponding to the combined input signal.

12. One or more non-transitory computer readable media storing instructions that, when executed by one or more processors, cause the one or more processors to perform the steps of:

generating a first auditory masking pattern based on a frequency spectrum of at least a first frame of a first audio signal;

generating a first calibration signal based on the first auditory masking pattern;

producing a combined input signal based on the first audio signal and the first calibration signal; and performing one or more calibration operations based on the combined input signal.

13. The one or more non-transitory computer readable media of claim 12, further comprising:

providing the combined input signal to a speaker device; and receiving, from a microphone device, a second audio signal corresponding to the combined input signal, wherein the one or more calibration operations are performed based on a coherence between the combined input signal and the second audio signal.

14. The one or more non-transitory computer readable media of claim 13, wherein the first calibration signal is generated to maintain a threshold coherence between the combined input signal and the second audio signal.

15. The one or more non-transitory computer readable media of claim 13, wherein the microphone device and the speaker device are included in a system configured for augmented reality or virtual reality, wherein the system further includes a display source.

16. The one or more non-transitory computer readable media of claim 12, wherein the first audio signal has a first coherence with a second audio signal, the combined input signal has a second coherence with the second audio signal, and the second coherence is larger than the first coherence.

17. The one or more non-transitory computer readable media of claim 12, wherein producing the combined input signal comprises combining the first frame of the first audio signal with the first calibration signal.

18. The one or more non-transitory computer readable media of claim 12, wherein producing the combined input signal comprises combining a second frame of the first audio signal with the first calibration signal.

19. The one or more non-transitory computer readable media of claim 12, wherein the first audio signal attenuates at least a portion of the first calibration signal.

20. A system, comprising:

a calibration module that:

generates a first auditory masking pattern based on a frequency spectrum of at least a first frame of a first audio signal;

generates a first calibration signal based on the first auditory masking pattern;

produces a combined input signal based on the first audio signal and the first calibration signal; and performs one or more calibration operations based on the combined input signal.

21. The system of claim 20, further comprising a microphone device, a speaker device, and a display source configured for augmented reality or virtual reality.

* * * * *